US006416447B1

(12) United States Patent
Harmon

(10) Patent No.: US 6,416,447 B1
(45) Date of Patent: Jul. 9, 2002

(54) ADAPTABLE RANGE-OF-MOTION EXERCISE APPARATUS

(76) Inventor: Larry Shane Harmon, P.O. Box 1706, Park City, UT (US) 84060

( * ) Notice: Subject to any disclaimer, the term of this patent is extended or adjusted under 35 U.S.C. 154(b) by 0 days.

(21) Appl. No.: 09/337,625

(22) Filed: Jun. 21, 1999

(51) Int. Cl.[7] ..... A63B 21/04

(52) U.S. Cl. ..... 482/129; 482/142; 482/121; 482/133

(58) Field of Search ..... 482/142, 129, 482/121–123, 141, 148, 130, 133, 135, 907, 904, 111–119, 92, 38–42; 128/25 R

(56) References Cited

U.S. PATENT DOCUMENTS

| | | | |
|---|---|---|---|
| 2,223,309 | A | 11/1940 | Swanson |
| 2,305,548 | A | 12/1942 | Nichols |
| D192,367 | S | 3/1962 | Marvosh |
| 3,397,884 | A | 8/1968 | Blasi |
| 3,524,641 | A | 8/1970 | Ossenkop |
| 3,524,644 | A | 8/1970 | Kane |
| 3,612,042 | A | 10/1971 | Fry |
| 3,638,941 | A | 2/1972 | Kulkens |
| 3,640,529 | A | 2/1972 | Kane |
| 3,707,285 | A | 12/1972 | Martin |
| 3,985,354 | A | 10/1976 | Schulkin |
| 4,293,127 | A | 10/1981 | Dudley |
| 4,385,760 | A | 5/1983 | Mattox et al. |
| 4,517,966 | A | 5/1985 | von Othegraven |
| 4,566,691 | A | 1/1986 | Mahnke |
| 4,645,197 | A | 2/1987 | McFee |
| 4,966,362 | A | 10/1990 | Ramaekers |
| 5,048,825 | A | 9/1991 | Kelly |
| 5,071,119 | A | 12/1991 | Johnson |
| 5,078,388 | A | 1/1992 | Dempsey, Jr. |
| 5,125,878 | A | 6/1992 | Wingate et al. |
| 5,320,591 | A | 6/1994 | Harmon et al. |
| 5,478,299 | A | 12/1995 | Harmon et al. |
| 5,529,550 | A | 6/1996 | Maycock, Jr. et al. |
| 5,913,749 | A | 6/1999 | Harmon |

*Primary Examiner*—Jerome W. Donnelly
(74) *Attorney, Agent, or Firm*—Clayton, Howarth & Cannon, P.C.

(57) ABSTRACT

A resistance exercise apparatus is provided which includes structures for receiving a body extremity of a user, the means for receiving a body extremity subject to a force provided by the body extremity, structures for maintaining the means for receiving a body extremity in a predefined plane during movement; and resistance providing devices to impose resistance against the movement of the body extremity. Versions of the apparatus may positioned on a floor, on a wall, or be free standing. Various embodiments of the invention are particularly suited to provide range-of-motion exercises for legs, arms, and hands of the user for both recreational strengthening and physical therapy applications.

20 Claims, 20 Drawing Sheets

ADAPTABLE RANGE-OF-MOTION EXERCISE APPARATUS

BACKGROUND

1. The Field of the Invention

This invention relates generally to exercise apparatus and more specifically to a novel apparatus for exercising the human body which provides beneficial range-of-motion exercises.

2. The Background Art

Increasingly, individuals and groups are becoming conscientious of exercising and other health related habits, and making substantial efforts to improve the same. Responsive to this increased awareness, the health and physical fitness industries have grown tremendously in the last several years. New exercise products are being introduced continuously.

Virtually all resistance-type exercise devices and apparatus use one of three basic resistance principles. The first of these is isometrics, which is a static form of exercise wherein the joints are moved at a constant speed (0 degrees per second) against a constant resistance, that is, with no observable joint movement. For example, pushing the palms of the hands against one another is an isometric exercise. Studies indicate that isometric exercise increases strength primarily at the specific angle assumed by the joint when force is applied.

The second form of resistance is isotonics and involves movement of a joint throughout a range-of-motion against a constant resistance. The best example of isotonic exercise is the use of barbells or similar free weights. With traditional isotonics, there is no way to accommodate for biomechanical leverage changes that increase and decrease muscular efficiency throughout the range-of-motion. Therefore, the dynamically contracting muscle is only loaded maximally at its weakest point in the range-of-motion.

The third basic type of resistance exercise is isokinetics and entails exercise performed at a constant speed with totally accommodating resistance throughout the entire range-of-motion. This form of exercise requires specially designed, complex, and expensive equipment, and usually requires constant supervision by a educated trainer. Therefore, exercise apparatus utilizing the principle of isokinetics are generally not well suited to the individual who may wish to exercise within the confines of his own home or who cannot afford the great expense of such apparatus.

While a great number of exercise devices and apparatus are known which utilize either the isometric or isotonic method of exercise, there does not appear to be any apparatus in the exercise or therapy, field which combines these two principles. A great advantage would be gained thereby, since both of these principles have distinct advantages. For example, isometric exercises provide the following important advantages: less joint irritation since there is no joint motion, increase of static muscular strength, reduction in swelling of joints, and isometric exercises can be performed anywhere in relatively short periods of time.

Similarly, some of the advantages of isotonic exercises are: ready availability, provides motivation by achievement (the user is able to lift more weight as muscles are strengthened), improves muscular endurance, is objectively documentable, and increases muscular strength with relatively few repetitions.

In addition to combining these desirable advantages, an exercise apparatus utilizing both isometrics and isokinetics would obviate the above-mentioned problem associated with isotonic exercise of maximally loading the dynamically contracting muscle at only its weakest point. Instead, the apparatus could be adjusted such that maximal loading could occur at any of the several points along its limited range-of-motion. Thus, it becomes clear that an exercise apparatus combining the advantages of both isometric and isotonic exercise would be a great advance in the art. Moreover, such an apparatus would have great benefits as a physical therapy device for use by those who have suffered an injury or who have reduced capacity for exercise.

BRIEF SUMMARY AND OBJECTS OF THE INVENTION

In view of the above described state of the art, the present invention seeks to realize the following objects and advantages.

It is a primary object of the present invention to provide an exercise apparatus which is adaptable to a variety of different circumstances and user conditions.

Another object of this invention. is to provide a combined isometric/isotonic resistance exercise apparatus providing the advantages inherent in both of these resistance methods.

Another object of this invention is to provide an apparatus for providing range-of-motion exercises for different extremities of the human body.

It is another object of the invention to provide an exercise apparatus which is self-contained and adjustable to provide many different exercises, each exercise focusing on and isolating different muscle groups.

Another object of this invention is to provide an apparatus for conveniently providing bidirectional exercise of different extremities of the human body.

It is yet another object of the present invention to provide an exercise apparatus which is lightweight and portable.

It is still another object of the present invention to provide an exercise apparatus which is easily manufactured and relatively inexpensive.

It is a further object of the present invention to provide an exercise apparatus which is efficient, durable, easily assembled, and operable by one user without assistance from another person.

It is yet another object of the present invention to provide apparatus which can be adapted for use in a commercial or residential fitness setting and in a medical or physical therapy setting.

These and other objects and advantages of the invention will become more fully apparent from the description and claims which follow, or may be learned by the practice of the invention.

Accordingly, the exercise apparatus of the present invention comprises generally means for receiving a body extremity, said means for receiving a body extremity receiving a directional force provided by the body extremity, means for maintaining the means for receiving a body extremity in a predefined plane during movement, and means for providing resistance to movement upon application of the force to the means for receiving a body extremity.

At present preference, the means for receiving a body extremity comprises a bar to be grasped or otherwise contacted by a body extremity, such as a hand. Alternatively, for example, one or more slings is provided into which a body extremity is inserted.

A preferred means for maintaining the means for receiving a body extremity in a predefined plane during movement comprises a cylindrical sleeve securely attached to each end of the bar, each sleeve being slidably mounted on a post. The two posts combine to form a plane within which movement of the bar is limited. It will be appreciated that the predefined plane can be either flat or curved.

One means for providing resistance can preferably comprise a cord formed of a material exhibiting elastic properties which is securely attached near the bottom and top end of each vertically disposed post. The cord is attached to one of the sleeves slidably mounted on the vertically disposed posts to impose resistance to movement by the body extremity.

Another preferred means for providing resistance can comprise a pneumatic resistance device. For example, an air cylinder which includes a piston and variable resistance controls can be utilized to impose resistance against the movement of body extremity. If desired, both an elastic resistance providing device and a pneumatic resistance providing device can be included.

This invention may also include a support structure, depending upon the intended use thereof. For example, the apparatus may be self supporting and include a bench or chair upon which the user sits or lays. Such free-standing embodiments of the present invention may be adapted to provide access to a wheelchair so that person confined to the wheelchair can obtain the advantages of the invention. Alternatively, the apparatus may be adapted for connection to a standard hospital bed so that a person confined thereto can also obtain the advantages of the invention.

Some embodiments of the invention may be attached to a vertical surface, such as a wall, or to some other non-horizontal surface. When attached to a wall, the user may sit upon a user support structure which preferably includes adjustments for height, angle or leg support, and angle of back support. Alternatively, the user may stand, squat, or lay down when using the wall-mounted embodiment. Additional embodiments of the present invention are particularly suited and sized for exercising user's hand and fingers which can be used on a table top or held aloft by the user. In embodiments of the present invention for exercising the hand, the user grasps structures which are provided with an ergonomic curve to ensure that the palm and fingers of the hand are oriented at a proper angle for flexion and extension motion. Importantly, all embodiments of the present invention can be adjusted to properly orient the apparatus to provide suitable range-of-motion exercises.

In one example of use of the present invention, the user grasps the bar or other extremity holding devices, or otherwise contacts the same, and exerts a force. The position of the bar can be varied to accommodate different positions for a body extremity. The bar is be pushed or pulled by a variety of body extremities or parts, as desired, to work the muscle group to be exercised. Responsive to the force exerted, the bar provides resistance to the movement of the body extremity. In some cases, the body extremity is allowed to move only a small amount. By limiting the movement of the bar to a slight distance, regardless of the force exerted, the benefits of both isometric and isotonic resistance exercises are effectively combined.

These and other objects and advantages of the invention will become more fully apparent from the description and claims which follow, or may be learned by the practice of the invention.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Further information regarding a related apparatus can be found in U.S. patent application Ser. No. 08/259,037 filed on Jun. 13, 1994 entitled ADAPTABLE EXERCISE APPARATUS which is now incorporated herein by reference in its entirety.

Figure 1:
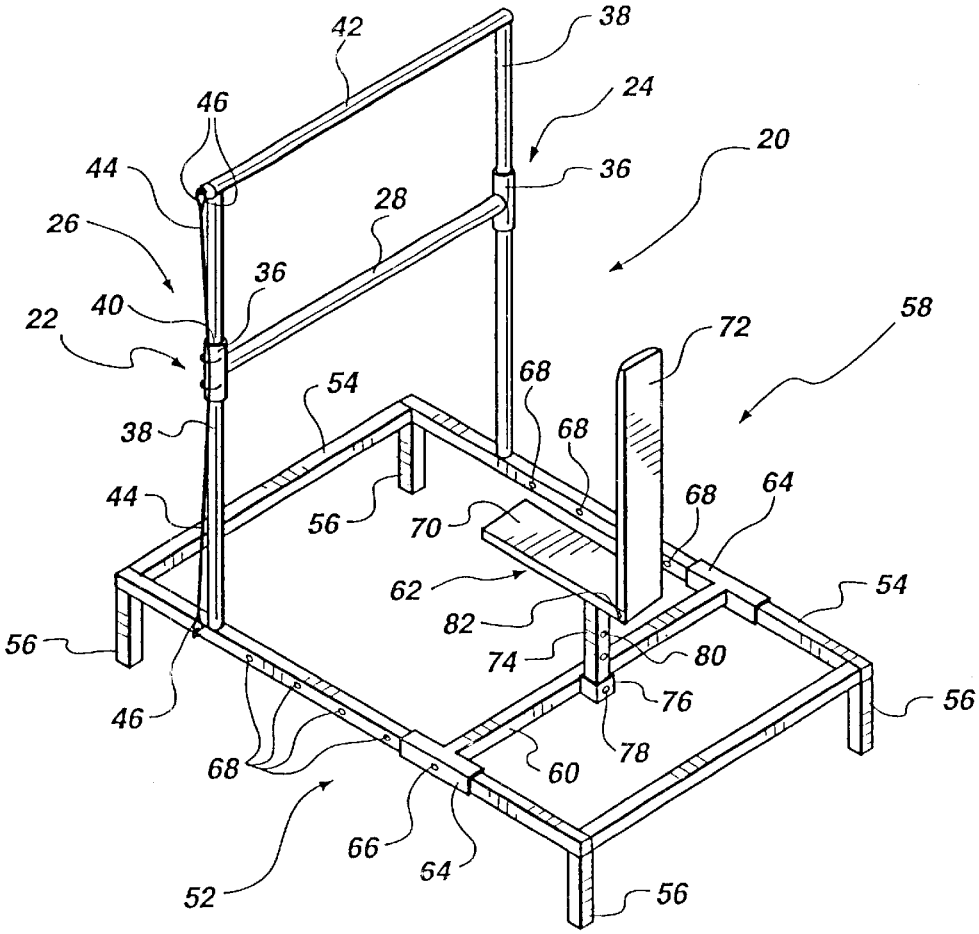
FIG. 1 is a perspective view of one presently preferred embodiment of the present invention intended for general purpose use.

Reference will now be made to the drawings in which like components are designated with like reference numbers throughout. Referring first to FIG. 1, a first presently preferred embodiment of the present invention, generally designated 20, is illustrated. The embodiment of FIG. 1 comprises one example of a means for receiving a body extremity of a user 22. The structures generally designated at 22 function as one presently preferred example of a means for receiving a body extremity of a user. The means for receiving a body extremity is subject to a force provided by the user (e.g., by an arm or a leg) and this force results in movement of the means for receiving a body extremity 22.

Also illustrated in FIG. 1 is one preferred structural arrangement of a means, comprising the structures generally designated at 24, for maintaining the means for receiving a body extremity 22 in a predefined plane during movement. In the illustrated embodiments, such movement is limited to a flat predefined plane but may also include curved planes or a flat plane oriented at a non-vertical angle as will be explained further shortly.

Also shown are representative structures, generally designated 26, functioning as a means for providing resistance to movement upon application of the force to the means for receiving the body extremity 22. Each of these components will be described in greater detail hereafter as well as alternative structures which can be used within the scope of the present invention.

Figure 3:
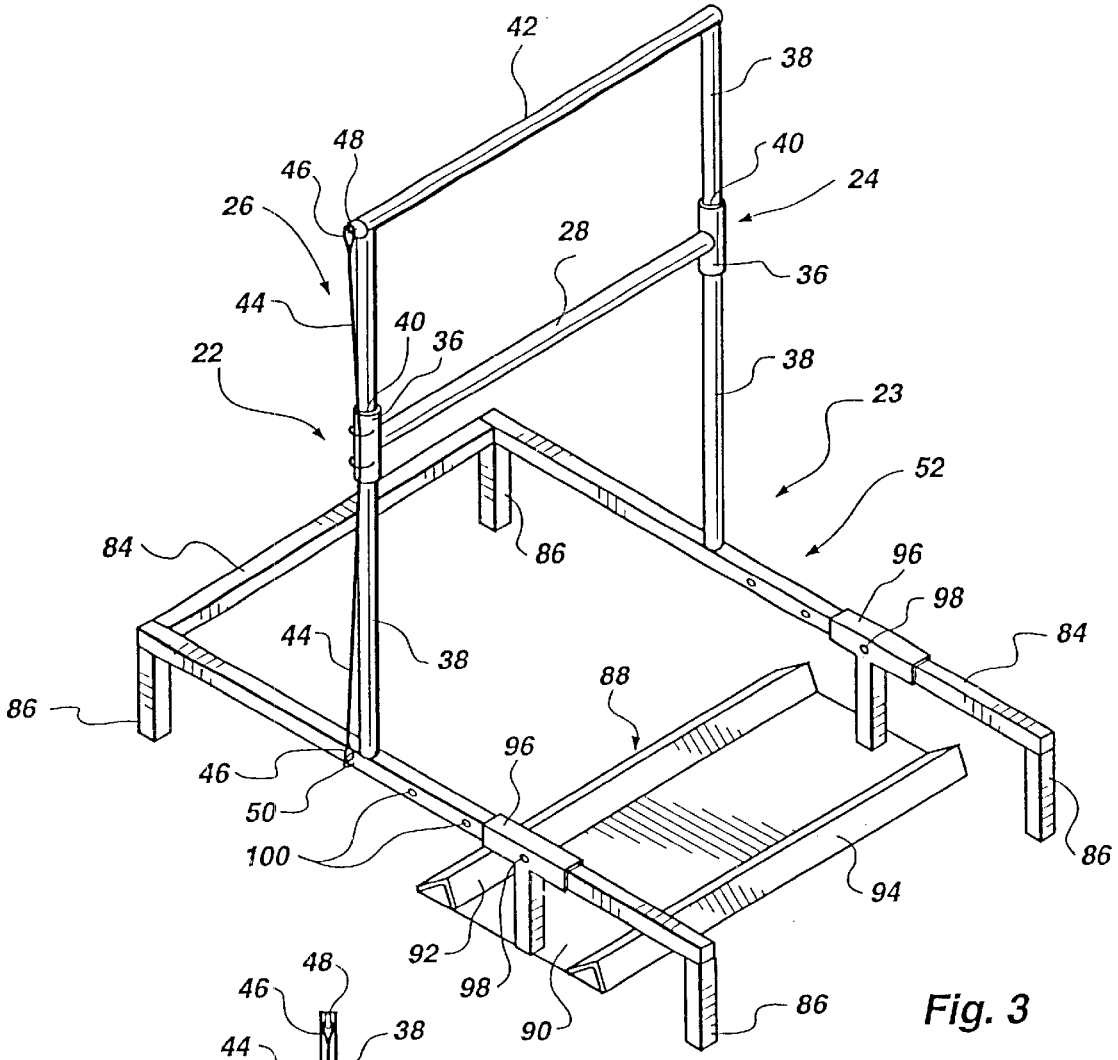
FIG. 3 is a perspective view of another preferred embodiment of the present invention adapted specifically for users confined to a wheelchair.

The means for receiving a body extremity of a user 22, in one of its preferred forms, is a rigid horizontal bar 28, which is formed of a suitable strong and rigid material. As shown in FIGS. 1 and 3, the bar 28 has two ends, both ends being securely attached to the sleeve 26 which function as part of the means for maintaining the means for receiving a body extremity in a predefined plane during movement.

Figure 6:
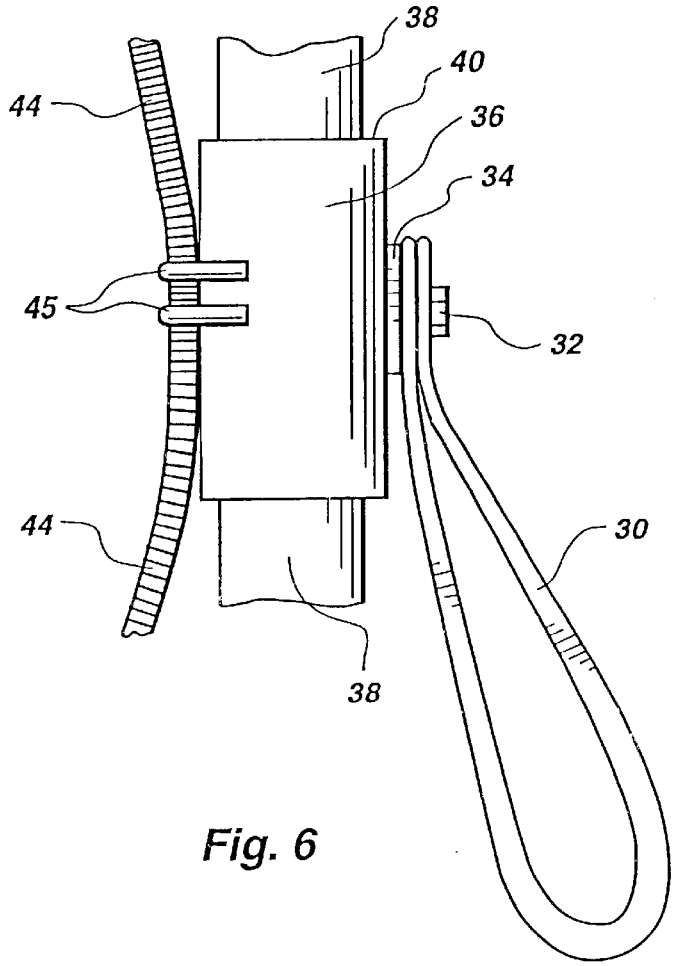
FIG. 6 is an enlarged elevational fragmentary view illustrating attachment of the flexible and elastic cord to a slidable sleeve with a sling attached thereto for holding a body extremity of a user.

Alternatively, the means for receiving the body extremity may be carried out by at least one sling 30 into which a body extremity can be inserted. FIG. 6 illustrates the sling 30 as being attached to a sleeve 36 as explained hereafter. Attachment thereof may be made by a bolt 32 in combination with a washer 34, the bolt 32 passing through apertures, not shown, formed in both ends of the sling 30, as well as through the washer 34. Alternatively, the sling 30 may be slidably attached to the rigid crossbar 28.

Those skilled in the art will recognize that the sling 30 may be attached in any of a number of different ways to the means 24, and that the attachment assembly shown in FIG. 6 is merely illustrative. Similarly, one skilled in the art will recognize that the means for receiving a body extremity. of a user may have a different form than the bar 28 or the sling 30, without departing from the scope of this invention, as will be discussed later. For example, a rigid handle attached to a supporting structure on one of its ends may also be used within the scope of the present invention as a means for receiving a body extremity.

In the illustrated embodiments, the means for maintaining the means for receiving a body extremity in a predefined plane during movement further limits such movement to one plane. In other embodiments, it may allow movement in a curved plane. In the embodiments illustrated in FIGS. 1–6, the means for maintaining comprises two sleeves 36 attached to the rigid bar 28 (which functions as a means for receiving a body extremity) and a post 38 upon which each sleeve 36 is slidably mounted.

As shown, each sleeve 36 is preferably cylindrical in shape and includes a hollow central portion 40. The post 38 upon which each sleeve 36 is slidably mounted passes through the central portion 40 of the sleeve 36. The posts 38 are generally oriented in an upright position, and are preferably disposed vertically to provide a vertical range-of-motion, and parallel, thus defining a flat plane. It is also within the scope of the present invention to dispose the posts 38 at an angle other than vertical as will be discussed later in this disclosure.

Each of the two parallel posts 38 is formed of a rigid material, for example a metal, and should have a fairly smooth exterior surface such that the sleeve 36 mounted on each post 38 slides freely thereon. The posts 38 may be characterized as including top, middle and bottom portions. The bottom portions of each post 38 are preferably attached to a base or frame, as detailed hereafter.

Figure 7:
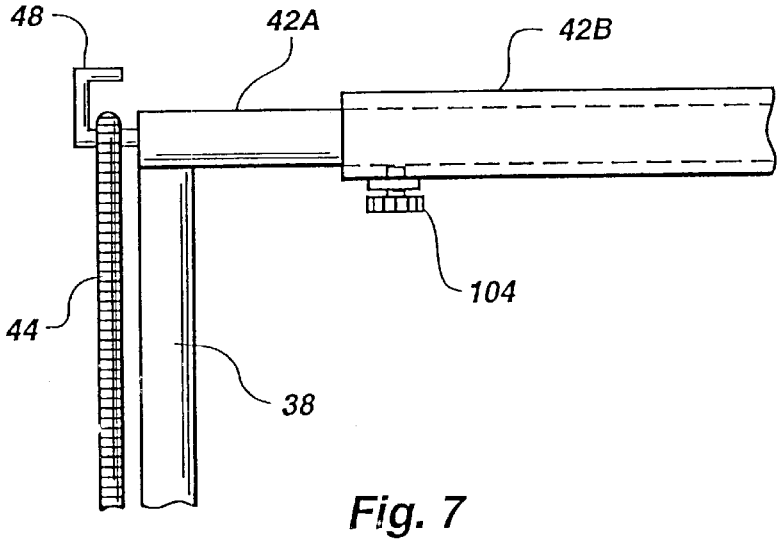
FIG. 7 is an enlarged elevational fragmentary view, according to the embodiment represented in FIG. 5, illustrating the attachment of the flexible and elastic cord near the top of a vertical post and further illustrating the securing of telescoping cross members after adjustment thereof.

In the illustrated embodiments, a crossbar 42 connects the top portions of the two parallel posts 38 together. The crossbar 42 has two ends, one end being fixedly attached to the top portion of each of the posts 38. This connection may be made in any manner known in the art. As shown in FIG. 7, the one preferred connection is made by a weld joining the post 38 and the crossbar 42.

Each sleeve 36 should be rigid and sized so as to accept one of the posts 38 in the hollow central portion 40 thereof in a snug, but not tight, slidable relationship. It will be apparent to one skilled in the art that the two upright parallel posts 38, in combination with the sleeves 36, define a flat plane within which movement of the attached means for receiving a body extremity, i.e., rigid bar 28, is limited.

Also included in the embodiments of the present invention is a means for providing resistance to movement of the body extremity. As shown in FIGS. 1–6, one preferred component for carrying out this function is formed from an elongated piece of material exhibiting elastic properties, such as a flexible cord 44. Other materials and devices, such as a sheet of elastic material or even a pneumatic or hydraulic device (either actively driven or passive), are contemplated to function as a means for providing resistance and fall within the purview of this invention. For example, one passive pneumatic device which can preferably be used within the scope of the present invention is known in the industry as BIMBA stainless steel air chambers Model no. 094-D and air release valves manufactured by SMC and designated no. AS2200 can also preferably used therewith to provide accurately variable resistance. Another preferred structure for providing resistance to movement is the flexible cord 44 which in one form is commonly referred to as "surgical tubing" Moreover, all of the described resistance providing structures have the advantage of being unitary structures which provide resistance in two directions, in contrast to two independent devices which each provide resistance in only one direction, e.g., springs.

It will be apparent that the resistance to movement provided by the flexible cord 44 is determined by the diameter thereof. The flexible cord 44 is pulled to a desired tautness and the first end of the flexible cord 44 is connected to or near the top portion of a post 38 and the second end of the flexible cord 44 is connected to the bottom portion of a post 38, as shown in FIG. 5. Alternatively, the second end of the flexible cord 44 is connected to a base, such as shown in FIGS. 1 through 4 and described hereafter.

Importantly, some portion of the flexible cord 44 is connected to the sleeve 36. If desired, clamps 45 may be arranged so that they releasably grip the flexible cord 44. This will allow the position of the sleeve 36 relative to the length of the flexible cord to be adjusted. In some circumstances, e.g., accommodating differing size users, adjusting the relative position of the sleeve 36 and the flexible cord 44 will be advantageous.

Figure 8:
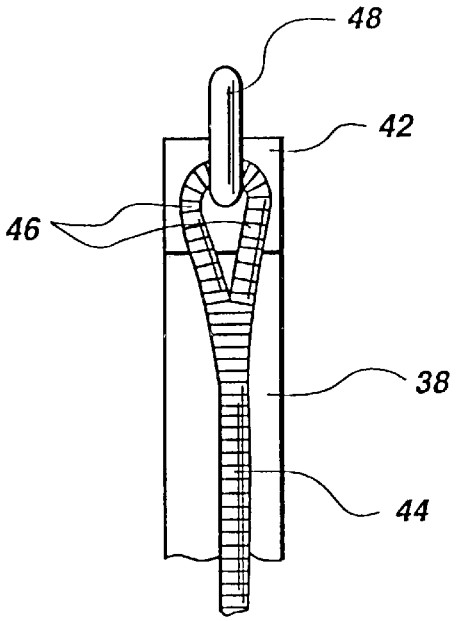
FIG. 8 is an enlarged elevational fragmentary view of the preferred manner in which the flexible and elastic cord is attached near the top of a vertically disposed post.
Figure 9:
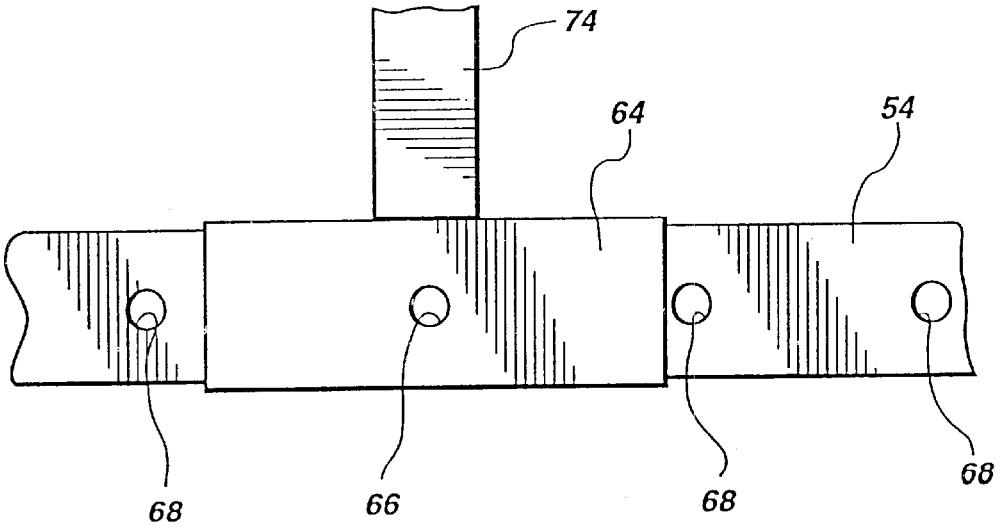
FIG. 9 is an enlarged elevational fragmentary view of the structures which can preferably be used to allow the components of the illustrated embodiments to be adjustably positioned.

FIGS. 6 through 8 illustrate a preferred flexible cord 44 and the manner in which it is attached to the post 38 and the sleeve 36, as mentioned. Both the first and second ends of the cord 44 comprise an integrated loop 46 (FIG. 8), although it should be recognized that the loop 46 may be formed in any manner known in the art. As shown, hooks 48 and 50 are securely attached, as by welding, near the top of each post 38, preferably to the crossbar 42, and bottom portion of each post 38, respectively. Alternatively, as shown in FIGS. 1 through 4, the bottom hook 50 may be fixedly attached to a base, described later herein.

Importantly, the middle portion of the flexible cord 44 is attached to a sleeve 36. See FIG. 6. With the top and bottom end portions of the cord 44 looped about top and bottom hooks 48 and 50, respectively, and the middle portion of the cord 44 attached to a sleeve 36, the rigid bar (28 in FIG. 1) or the sling (30 in FIG. 6), which function as means for receiving a body extremity, is held in place ready to receive a body extremity. The flexible cord 44 provides resistance to movement upon application of a force to the means for receiving a body extremity.

Figure 2:
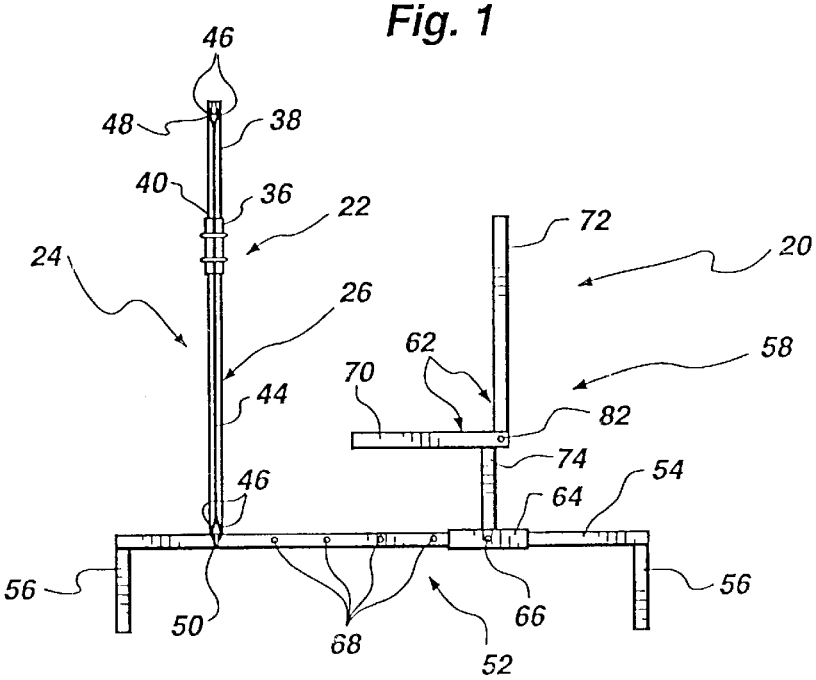
FIG. 2 is a side elevational view of the embodiment represented in FIG. 1.

Referring now to FIGS. 1 and 2, the apparatus 20 includes structural means such as a base or frame, generally designated at 52, which is self supporting. The base 52 of FIGS. 1 and 2 is formed of a rigid material and comprises a rectangular frame portion 54, a supporting leg 56 disposed at each corner of the rectangular frame portion 54, and an adjustable positioned assembly, generally designated at 58, for maintaining the user in a proper position relative to the other structures of the embodiment.

The adjustable positioned assembly 58 comprises a cross member 60 which is slidably mounted to opposing members of the frame portion 54, and an adjustable seat, generally designated at 62, upon which the user may sit or lay during operation of the illustrated apparatus. In the preferred embodiment, the cross member 60 includes integrated sleeves 64 through which opposing members of the frame portion 54 pass, similar to the relationship between each sleeve 36 and post 38.

In this manner, the position of the user is adjustably positioned relative to the bar 28 or slings 30 to allow the user to contact and provide a force against the bar 28 or slings 30, the force preferably resulting in no more than slight movement of the bar 28 or sling 30. As illustrated, each integrated sleeve 64 may include an aperture.66 which at certain positions corresponds, to one of a series of apertures 68 drilled or otherwise formed in the opposing members of the frame portion 54 to which the cross member 60 is mounted. A pin, or other similar well-known implement, not shown, may then be passed through aligned apertures 66 and 68 to secure the crossbar 60 in place during use.

The adjustable positioned assembly 58, shown in FIGS. 1 and 2, further comprises the adjustable seat, 62, which includes a pair of seat members 70 and 72 which are adjustable relative to each other between a coplanar position and a non-coplanar position, and an adjustable stem 74 by which the height of the adjustable seat 62 is manipulated.

The adjustable stem 74 is shown seated in a collar 76 which is fixedly attached to the cross member 60, near the center thereof. The collar 76 includes an aperture 78 which may be aligned with one of a series of apertures 80 drilled or otherwise formed in the stem 74. A pin, or other similar implement known in the art (not shown) is inserted through aligned apertures 78 and 80 to secure the adjustable seat 62 at the desired height.

The seat member 70, as illustrated, is preferably horizontal in orientation and is securely attached (as by welding) to the top end of the adjustable stem 74. The second seat member 72 is hingedly attached to the first seat member 70, thereby allowing for adjustment of the two seat members 70 and 72 between a coplanar and a non-coplanar relationship. The hinged connection may be made by a bolt 82 which passes through aligned apertures, not shown, in both of the seat members 70 and 72 near the edges thereof. A corresponding nut, not shown, would secure the bolt 82 in place. The seat members 70 and 72 may be padded to ensure the comfort of a user.

Figure 4:
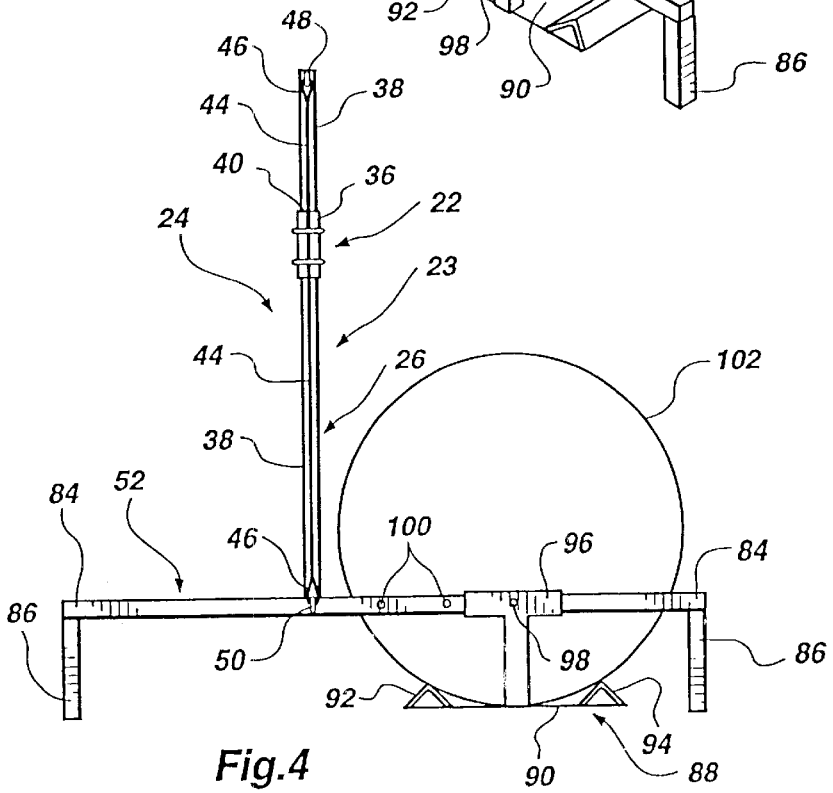
FIG. 4 is a side elevational view of the embodiment represented in FIG. 3 further illustrating the position of a typical wheelchair wheel.
Figure 5:
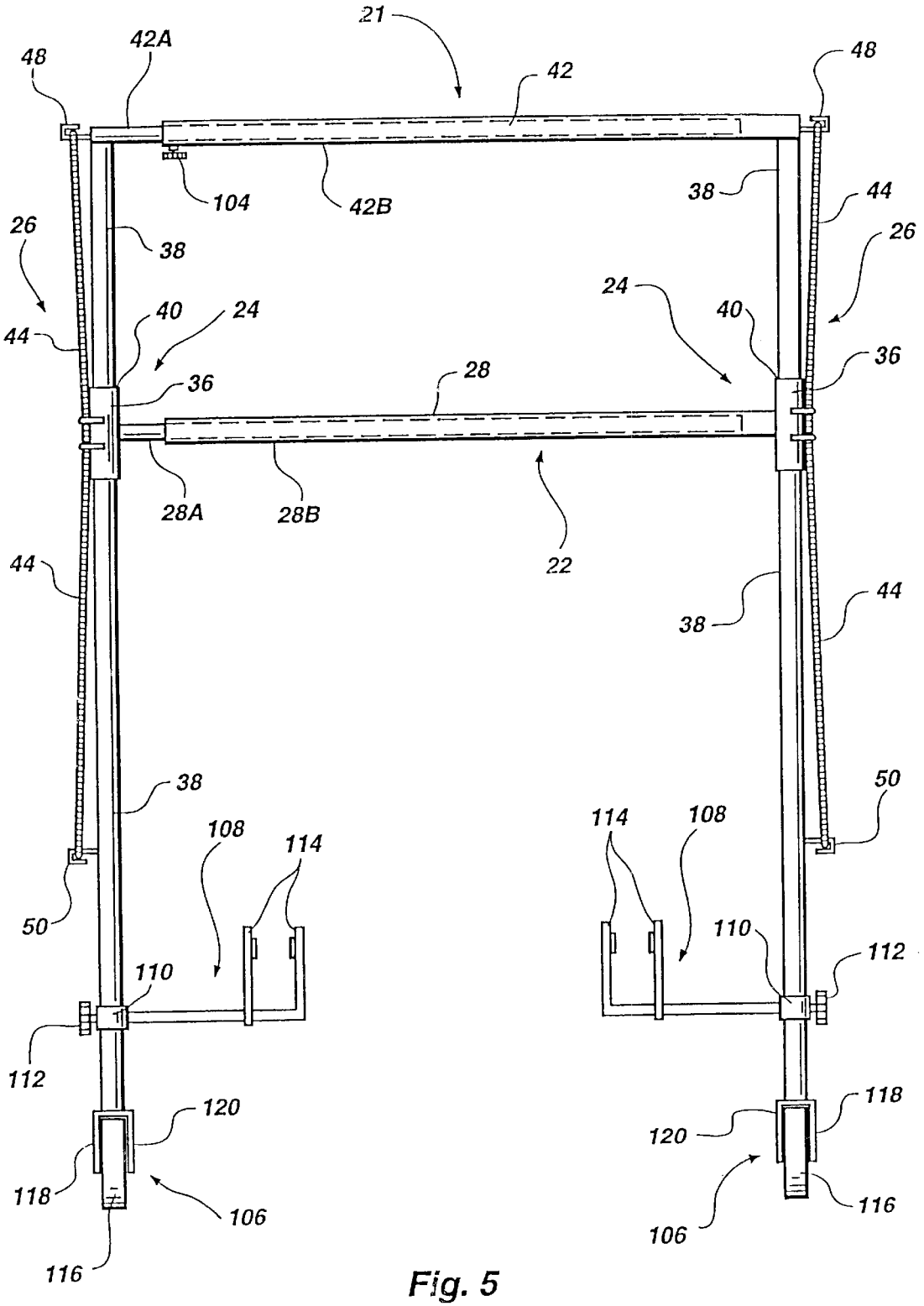
FIG. 5 is a front elevational view of still another preferred embodiment of the present invention specifically adapted for users confined to a bed.

An alternative embodiment of the present invention 23, which includes a modified base 52, is illustrated in FIGS. 3 and 4. The embodiment illustrated in FIGS. 3 and 4 is specifically adapted for operation by a user confined to a wheelchair. This embodiment includes a generally U-shaped frame portion 84, a supporting leg 86 disposed at each corner of the U-shaped frame portion 84 and another adjustable positioned assembly 96. The frame portion 84 and the supporting legs 86 are nearly identical to the frame portion 54 and supporting legs 56 of the embodiment of FIGS. 1 and 2, except that the frame portion 84 does not form a complete rectangle. One of the members of the frame portion 84 is absent to allow access to the adjustable position assembly, generally indicated at 88, by a wheelchair.

As illustrated in FIGS. 3 and 4, the adjustable positioned assembly 88 comprises a platform 90 which includes angle irons 92 and 94 welded or otherwise attached to the longitudinal edges thereof and T-shaped sleeves 96 by which the platform 90 is slidably mounted to opposing members of the frame portion 84. The platform 90 is formed of a rigid plate material, for example metal, fiberglass, or a composite or some other synthetic material, and disposed so as to rest on the surface supporting the apparatus 23. The angle irons 92 and 94 are also preferably formed of a rigid and durable material. The sleeves 96 are similar to the sleeves 64 of the embodiment shown in FIGS. 1 and 2, except that each is connected to the platform 90 which accommodates a wheelchair, rather than to the crossbar 60 upon which the adjustable seat 62 is mounted. Each sleeve 96 is fixedly attached to the platform 90.

The sleeves 96 function similarly to the sleeves 64 in that each sleeve 96 has an aperture 98, preferably identical to the aperture 66 (FIGS. 1 and 2), and is aligned with one in a series of apertures 100 in the frame portion 84, preferably identical to the series of apertures 68 (FIGS. 1 and 2) in the frame portion 54. Thus, as represented in FIG. 4, a wheelchair (not completely illustrated) having a wheel 102, is positioned on the platform 90 and the angle irons 92 and 94 prevent movement thereof during use and the sleeves 96 make the position of the platform 90 adjustable relative to the rigid bar 28.

Figure 4A:
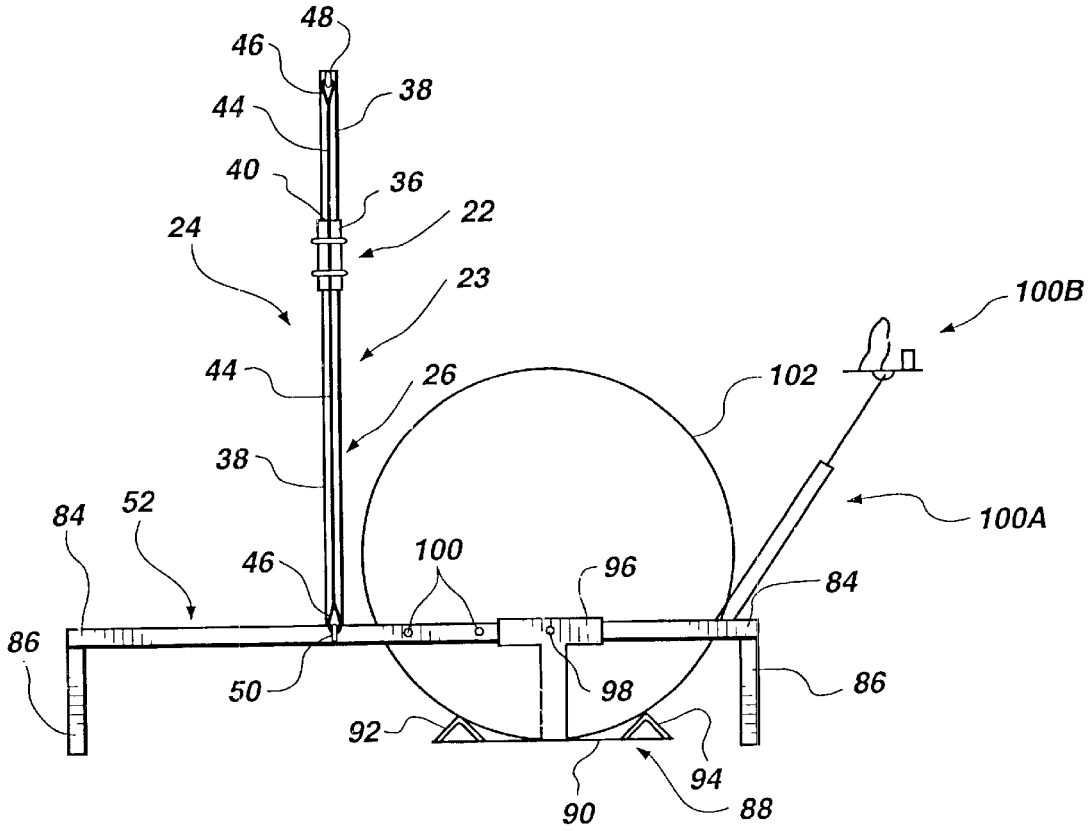
FIG. 4A is a side elevational view of another embodiment particularly suited for use with a wheelchair.

FIG. 4A provides a side view of another embodiment of the present invention similar to that illustrated in FIGS. 3 and 4. The apparatus illustrated in FIG. 4A includes wheelchair angular positioning structures comprising a telescoping strut generally indicated at 100A and a grasping structure generally indicated at 100B, preferably including a strap and buckle, which is pivotally attached to the telescoping strut 100A. The grasping structure 100B releasably grasps the handles of a wheelchair (not completely represented in FIG. 4A) and the telescoping strut 100A is pivotally attached to the frame portion 84. The length of the telescoping strut 100A can be selectively locked allowing the wheelchair to be tilted to the desired angular orientation. Thus, the position and orientation of the wheelchair can be adjusted to provide movement in whichever appropriate range-of-motion is desired. It will also be appreciated that the structures represented in FIGS. 3, 4 & 4A which facilitate wheelchair use can also be incorporated into any of the other embodiments of the present invention described herein.

Referring now to FIG. 5, another embodiment of the present invention, generally indicated at 21, is shown. The embodiment illustrated in FIG. 5 is particularly intended for connection to a hospital bed or the like. In this embodiment, the bar 28 and the crossbar 42 each comprise two separate telescoping members (28A–B and 42A–B, respectively), the crossbar 42 including a screw 104 for securing the telescoping members in the desired position. In this manner, the apparatus 21 can be adjusted to fit beds having differing widths.

Also, in the embodiment represented in FIG. 5, the parallel posts 38 are extended and include at the bottom portions thereof wheel assemblies, generally indicated at 106, to assist in transporting the apparatus 21 to and from the bed. Each post 38 further includes adjustable clamps, generally designated at 108, by which the apparatus 21 may be temporarily connected to the frame of the bed in which the user is confined.

As shown in FIG. 5, the clamps 108 include a collar 110 which can be adjustably positioned along the length of the post 38 by a screw 112, and a set of receiving jaws 114. The receiving jaws 114 have a standard locking mechanism, not shown, by which the jaws 114 are locked into a fixed position about the frame of the bed. The wheel assembly 106 is common in the art and may include a wheel 116 rotatably mounted between parallel arms 118 and 120, an axle, not shown, passing through both arms 118 and 120, as well as through the center of the wheel 116. It may be desirable to include a pair of wheels or casters in place of wheels 116 so that the apparatus 21 will be free standing for transport and storage. In this embodiment, the bottom hook 50 which secures the bottom portion of the cord 44, is fixedly attached to the bottom portion of the post 38.

Because of the tautness of the cord 44, movement of the means 22 for receiving a body extremity responsive to a force applied thereto will generally not exceed a few inches in either direction of the resting position. In this manner, a user properly positioned adjacent to the means for receiving (22), grasps or otherwise contacts the means for receiving (22) and exerts a force thereon utilizing one or more muscle groups. The position of the user and the position of the adjustable seat 62 (FIGS. 1 and 2) determine the muscle group or groups to be involved.

Because of the characteristics of resistance providing device illustrated in FIGS. 1–10, only slight movement preferably generally results from application of the force by a body extremity or other body part. Still, such movement prevents classification of the apparatus as a strictly isometric device. However, in some embodiments of the present invention the full range-of-motion of which the user is capable is also prevented, thus preventing classification of the apparatus as strictly isotonic. Rather, many embodiments of the present invention effectively combine both of these principles to provide the advantages inherent in each.

Figure 5A:
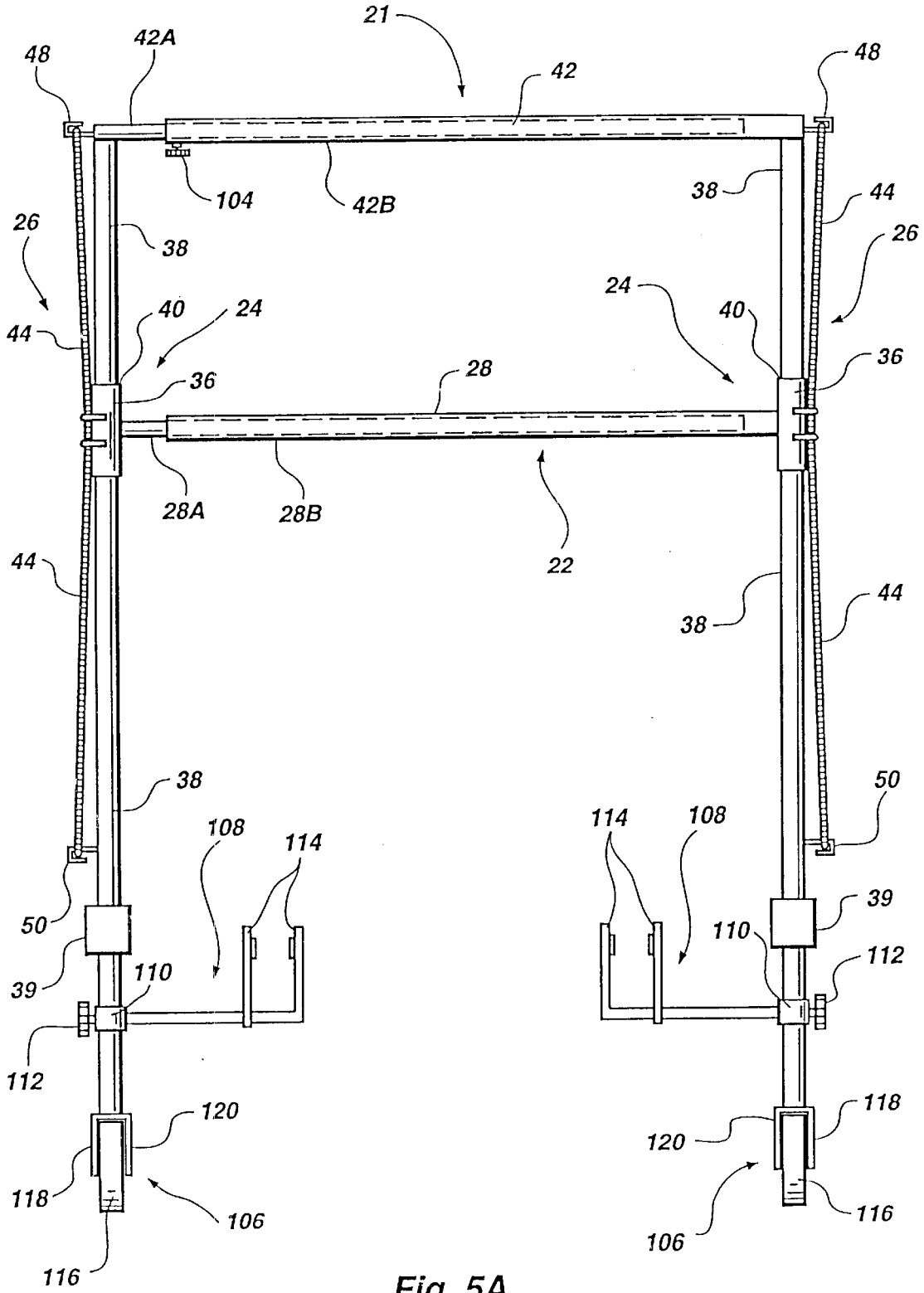
FIG. 5A is a front elevational view another embodiment of the present invention similar to the embodiment represented in FIG. 5 which includes a pivoting mechanism.

FIG. 5A illustrates another preferred embodiment of the present invention similar to the embodiment represented in FIG. 5 but which includes a pivoting structure, represented by the box 39, provided near the bottom of the post 38. A suitable mechanism for the pivoting structure 39 can readily be devised by those skilled in the art. Also, the pivoting mechanisms represented in FIGS. 10–12 can be adapted for use with the other embodiments described herein.

Figure 10:
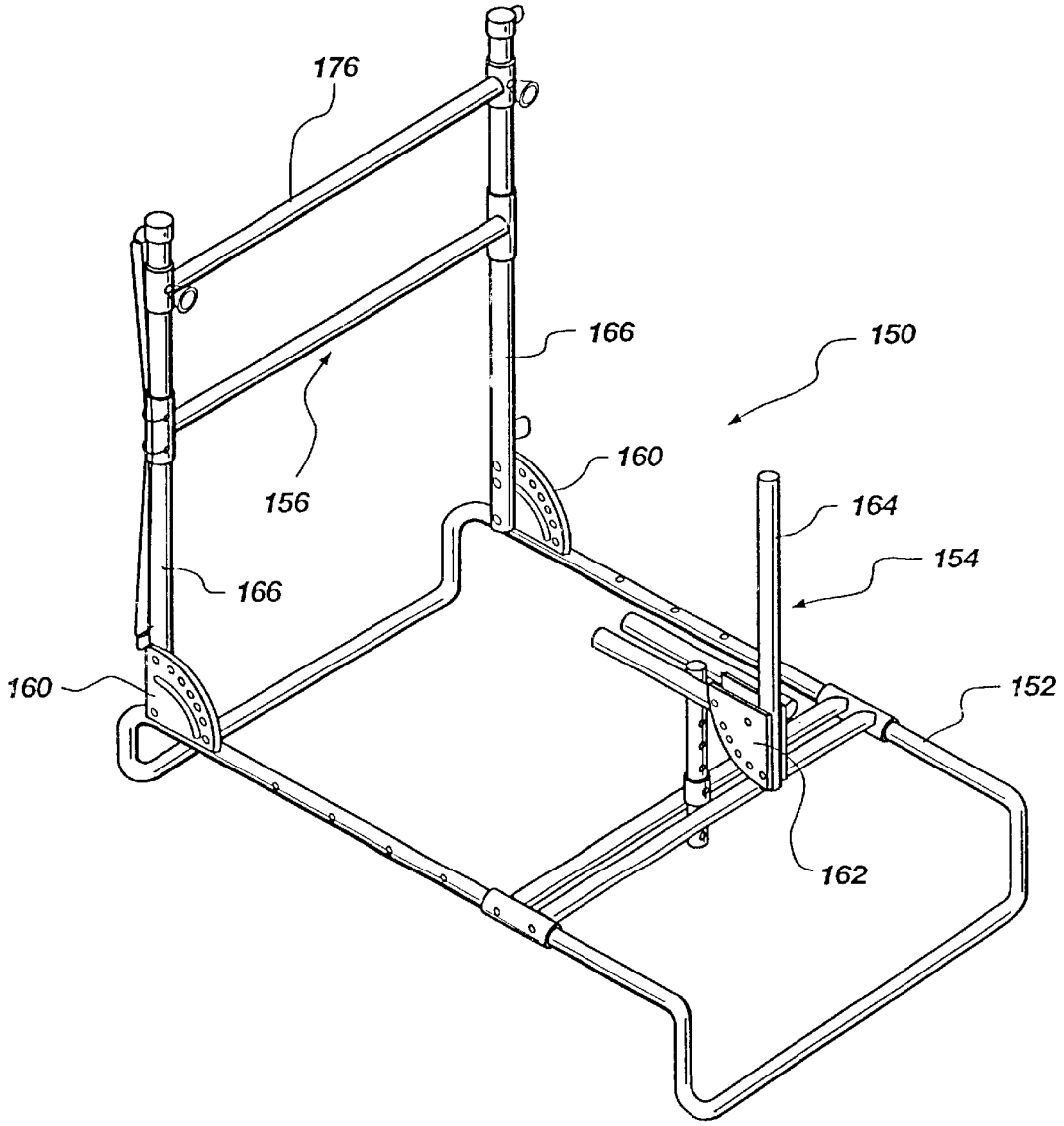
FIG. 10 is a perspective view of another embodiment of the present invention.
Figure 11:
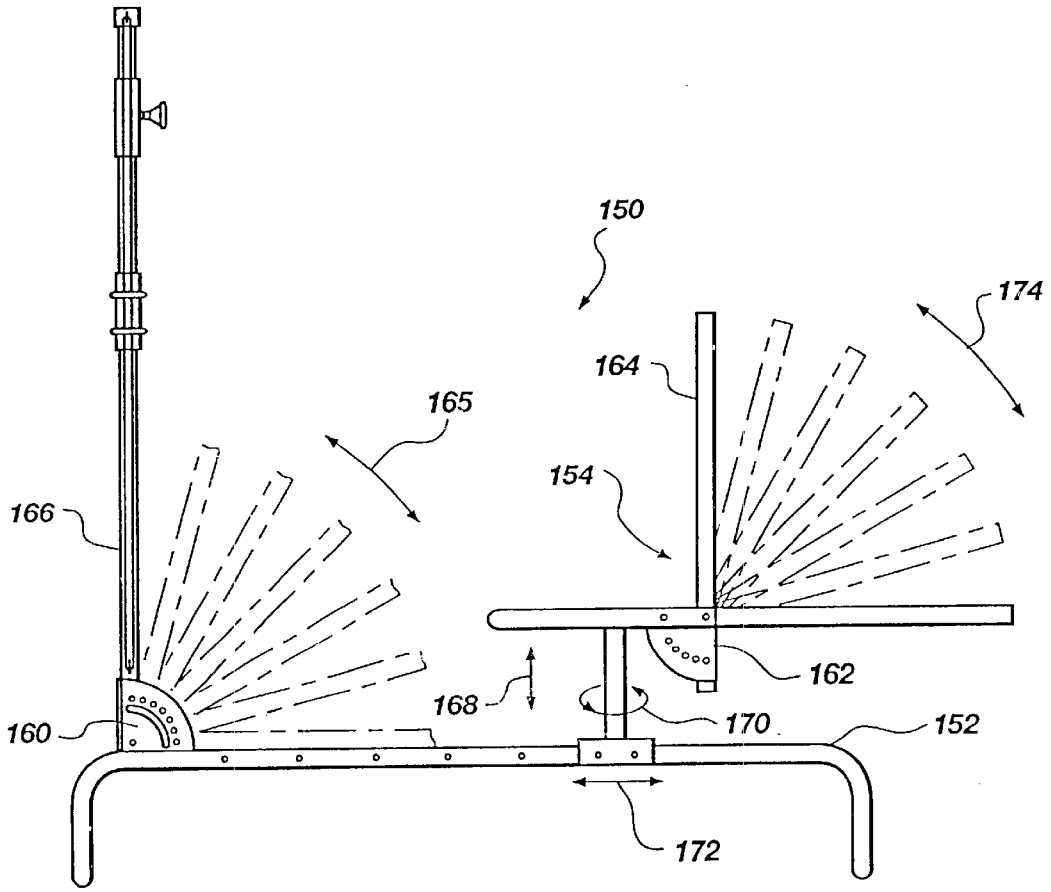
FIG. 11 is a side elevational view of the embodiment illustrated in FIG. 10.
Figure 12:
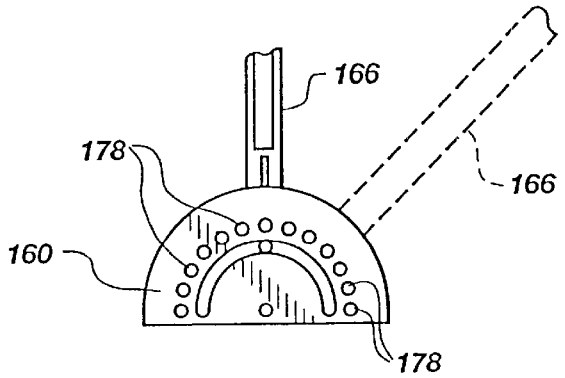
FIG. 12 is a detailed elevational view of a portion of the embodiment illustrated in FIG. 11.

FIGS. 10–12 illustrate another preferred embodiment of the present invention. The embodiment of FIGS. 10–12 shares many of the essential characteristics of the structures illustrated in FIGS. 1–9 with additional desirable structures added thereto. As will be appreciated, the structures represented in FIGS. 10–12 provide the important advantage of allowing the angular orientation of pertinent structures to be varied so that the relationship between the user's body and a rigid horizontal bar assembly, generally designated at 156, can be carefully selected and retained during exercise so that maximum benefit to the user can be obtained. It will be understood that selecting and retaining the proper relationship between the user's body and the bar assembly 156 is important to obtaining maximum benefit for the user by allowing a particular muscle group or groups to be exercised.

Referring now to FIG. 10, many of the illustrated structures are similar to those described in connection with FIGS. 1–9 and thus repetitious explanation will not be given here. Similarly to the earlier described structures, a frame 152 is provided. A seat support assembly is generally designated at 154. The seat support assembly 154 is the presently preferred arrangement for the means for supporting the user's body. The seat support assembly 154 is shown as a skeleton ready to receive, for example, upholstered pads (not illustrated).

The seat support assembly 154 can be adjustably positioned along the frame 152 in a manner similar to that described earlier herein in connection with cross bar 60 and sleeves 64 (FIGS. 1 and 2). The illustrated arrangement is the preferred structure for providing a means for adjusting the distance between the seat and the horizontal bar assembly 156.

A seat back support 164 is also provided with a pivoting structure 162 which allows the angular orientation of the seat back support 164 to be adjusted and held in place. Also, similarly to the function described earlier herein for the adjustable seat 62 (FIGS. 1 and 2), the height of the seat support assembly 154 can be adjusted using the illustrated means for adjusting the height of the seat support assembly. Furthermore, as will be explained more fully shortly, the seat support assembly 154 can also be rotated.

Also illustrated in FIG. 10 are two posts 166 which function to keep the movement of the horizontal bar assembly 156 in a predefined plane similarly to the earlier described corresponding structures. Desirably, pivoting structures 160 are provided to orient the predefined plane in which the horizontal bar assembly 156 moves in any one of a plurality of angular orientations. A crossbar 176 connects the two posts 166 together and assists with keeping the posts 166 parallel.

Referring next to the side elevational view of FIG. 11, the function of the pivoting structures is more particularly shown. As represented by the arrows provided in FIG. 11, the seat support assembly 154 can be adjusted vertically (arrow 168), rotated (arrow 172), and positioned horizontally (arrow 172). These adjustments allow the orientation of the seat support assembly 154 to be altered in three planes in relation to the horizontal bar assembly 156. Moreover, the pivoting structure 162 allows the seat back support 164 to be adjusted to any one of the plurality of angular positions in the plane represented by arrow 174.

Also represented in FIG. 11 is a pivoting structure 160 which allows the angular orientation of the posts 166 to be altered and held in any of a plurality of positions in the plane represented by arrow 165. FIG. 12 provides a detailed view of the pivoting structure 160 and the angular orientations provided thereby. The pivoting structures 160 and 162 are the preferred structures for carrying out the means for pivoting of the present invention. It is preferred that the illustrated pivoting structures 160 and 162 can usefully provide an angular range of anywhere from one-hundred and eighty degrees to fifteen degrees. It is most preferred that the pivoting structures 160 and 162 provide an angular range of ninety about degrees or about forty-five degrees.

Those skilled in the art will be able to devise alternative arrangements to carry out the function of pivoting structures 160 and 162. For example, pins of some kind may be inserted into bores 178 (identified in FIG. 12) of the pivoting structures 160 and 162 or some other arrangement can be used.

It will be appreciated that the angular adjustments for the seat assembly 154 and the posts 166 illustrated in FIGS. 10 and 11 provide even more flexibility and benefit for the user than if angular adjustment for just one component were provided. With the embodiment of the present invention represented in FIGS. 10–12, the orientation of the user's body in relation to the means for receiving a body extremity can be specifically adjusted and held in place.

Some embodiments of the present invention may have all, or just some, of the adjusting structures represented in FIGS. 10–12. Moreover, the structures represented in FIGS. 10–12 can be combined with those illustrated in the other figures provided herein to arrive at additional embodiments falling within the scope of the present invention.

Figure 13:
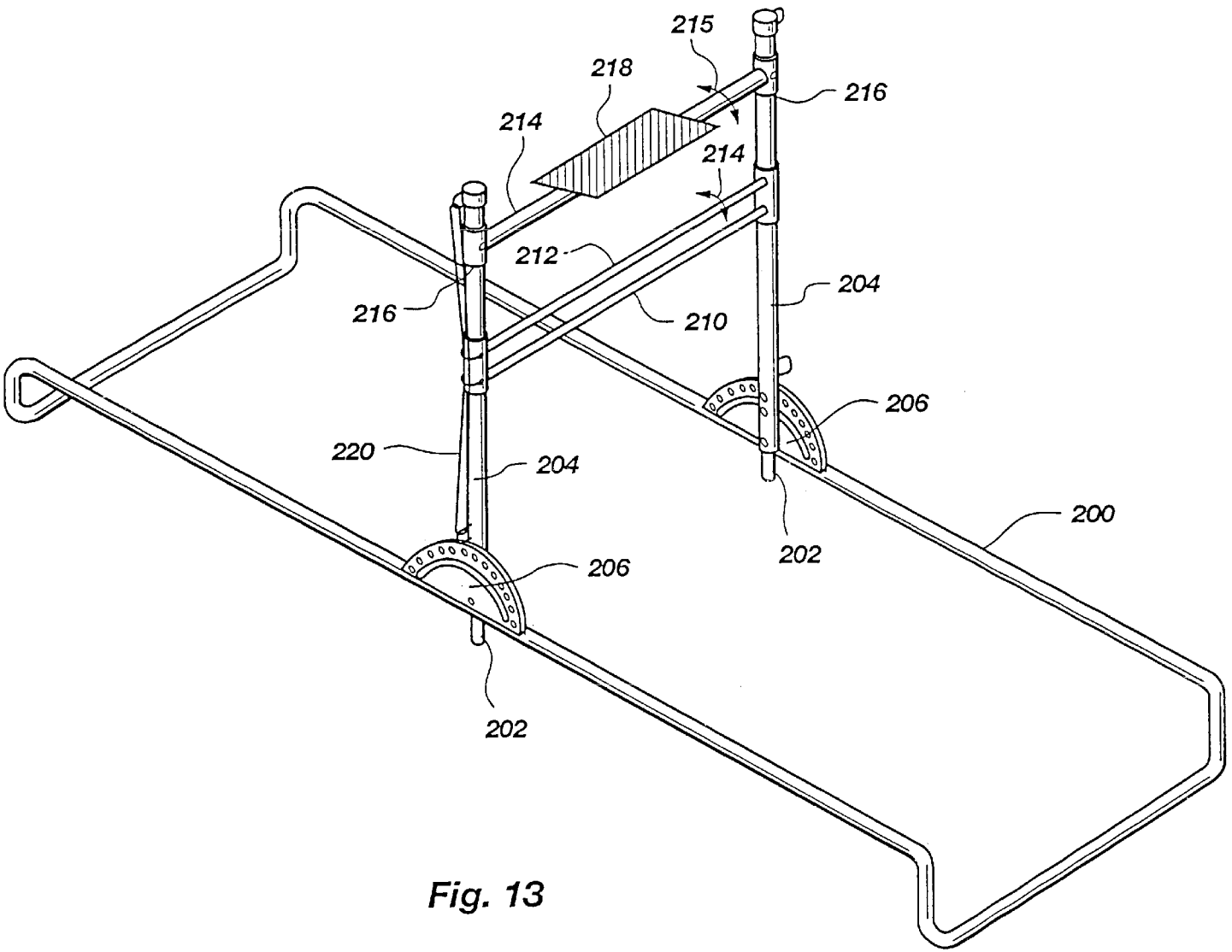
FIG. 13 is a perspective view of another embodiment of the present invention.

Reference will next be made to FIG. 13 which provides a perspective view of yet another preferred embodiment of the present invention. The embodiment of the present invention represented in FIG. 13 includes a frame 200 which can be fabricated in accordance with the same principles as applied with the earlier described embodiments. Also represented in FIG. 13 are two joints 202 which allow the frame 200 to fold upon itself for storage and/or transport which is a great advantage when the user must move the embodiment or if space is limited and the embodiment must be stored in a concealed location when not being used.

Also represented in FIG. 13 are two posts 204 which are connected to the pivoting structures 206. A sleeve 208 is provided on each post 204. Each sleeve 208 can slide along the length of the posts 204 in a fashion similar to that explained in the earlier described embodiments.

An upper bar 212 and a lower bar 210 are provided and are connected to sleeves 208 as indicated in FIG. 13. With both an upper bar 212 and a lower bar 210 connected to each sleeve 208, either bar can receive a body extremity of a user and the directional force provided by the body extremity. For example, the user may place one or both hands with palms facing downward toward lower bar 210 and the back of the hand facing the upper bar 212. In this way, the embodiment can resist the movement of the hand in when engaging in either extension or flexion movement without requiring the user to reposition the hand. Other body extremities can also be similarly accommodated.

The spacing between the upper bar 212 and the lower bar 210 can be fixed or structures can be provided to adjust the spacing to accommodate different body extremities. The upper bar 212 and the lower bar 210 can each be provided with appropriate padding and are preferably mounted in the sleeves 208 so that one or both can rotate in the direction of arrow 214.

Also illustrated in FIG. 13 is a support bar 214 which is connected at each of its ends to tubes 216 which are each provided with structures to adjustably hold the tubes 216, and thus the support bar 214, at one of many possible positions along the length of the posts 204. Also provided on the support bar 214 is an extremity rest 218. The extremity rest 218 is mounted so it can rotate about the support bar 218 in the direction of arrow 215. The extremity rest 218 is particularly useful for supporting the forearm of a user (not represented) as the user curls the fingers of one or both hands, and places said fingers from the rearward side, between the upper bar 212 and the lower 210 and engaging in exercise of said fingers. The position of the support bar 214, and the position and orientation of the extremity rest 218, can be adjusted to accommodate different users and different body extremities.

The flexible cord 220 provides resistance to movement of the upper bar 212 and the lower bar 210. Other resistance providing structures can also be used to resist the movement of the upper bar 212 and the lower bar 210. The embodiment represented in FIG. 13 can be fabricated in a size for use on a table top and used for conditioning or rehabilitation of a user's hand and wrist. The embodiment of FIG. 13 can be readily adapted for other applications as will be appreciated by those skilled in the art using the information set forth herein.

Figure 13A:
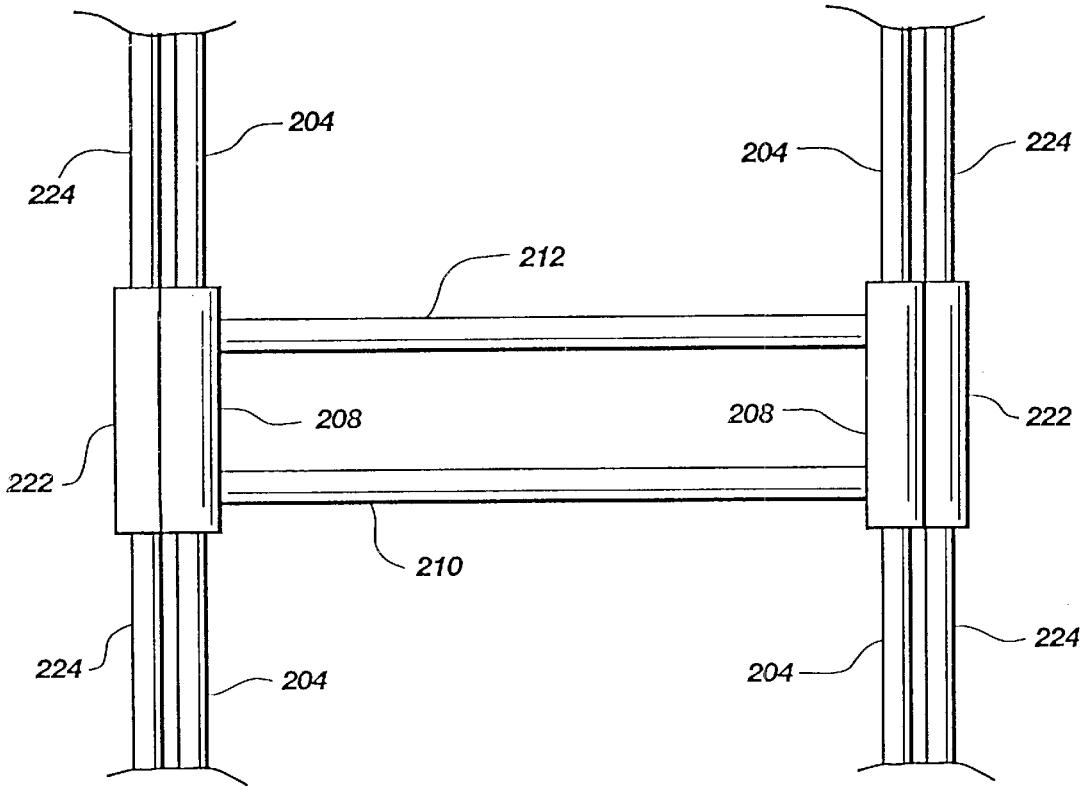
FIG. 13A is an end view of a portion of another embodiment of the present invention.

Reference will next be made to FIG. 13A which is a detailed view of a portion of another embodiment of the present invention. Represented in FIG. 13A are two posts 204, two sleeves, an upper bar 212 and a lower bar 210 all of which function similarly to the corresponding structures represented in FIG. 13. In contrast to the embodiment of FIG. 13, resistance to the movement of the body extremity is not provided by the flexible cord 220, but rather by two air cylinders 222. The air cylinders 222 can be the same or similar to those explained earlier and can be selected by those skilled in the art from the devices available in the industry.

The body of the air cylinders 222 is preferably attached to the sleeves 208 and pistons 224, protruding from each end of the air cylinders 222, are attached at their ends to the posts 204 or the frame (not illustrated in FIG. 13A) of the embodiment. It will be appreciated that many different pneumatic devices can preferably be used with the embodiments of the present invention. Importantly, the preferred air cylinders provide a unitary device which provides resistance in both directions of travel. The amount of resistance can be readily adjusted and accurately controlled. Moreover, the preferred air cylinders are durable and reliable. Those skilled in the art will appreciate that embodiments of the present invention can be devised which require only a single air cylinder 222 while it is preferred to provide two air cylinders 222 to provide the function of imposing a resistance against the movement of a user's extremity.

Figure 14:
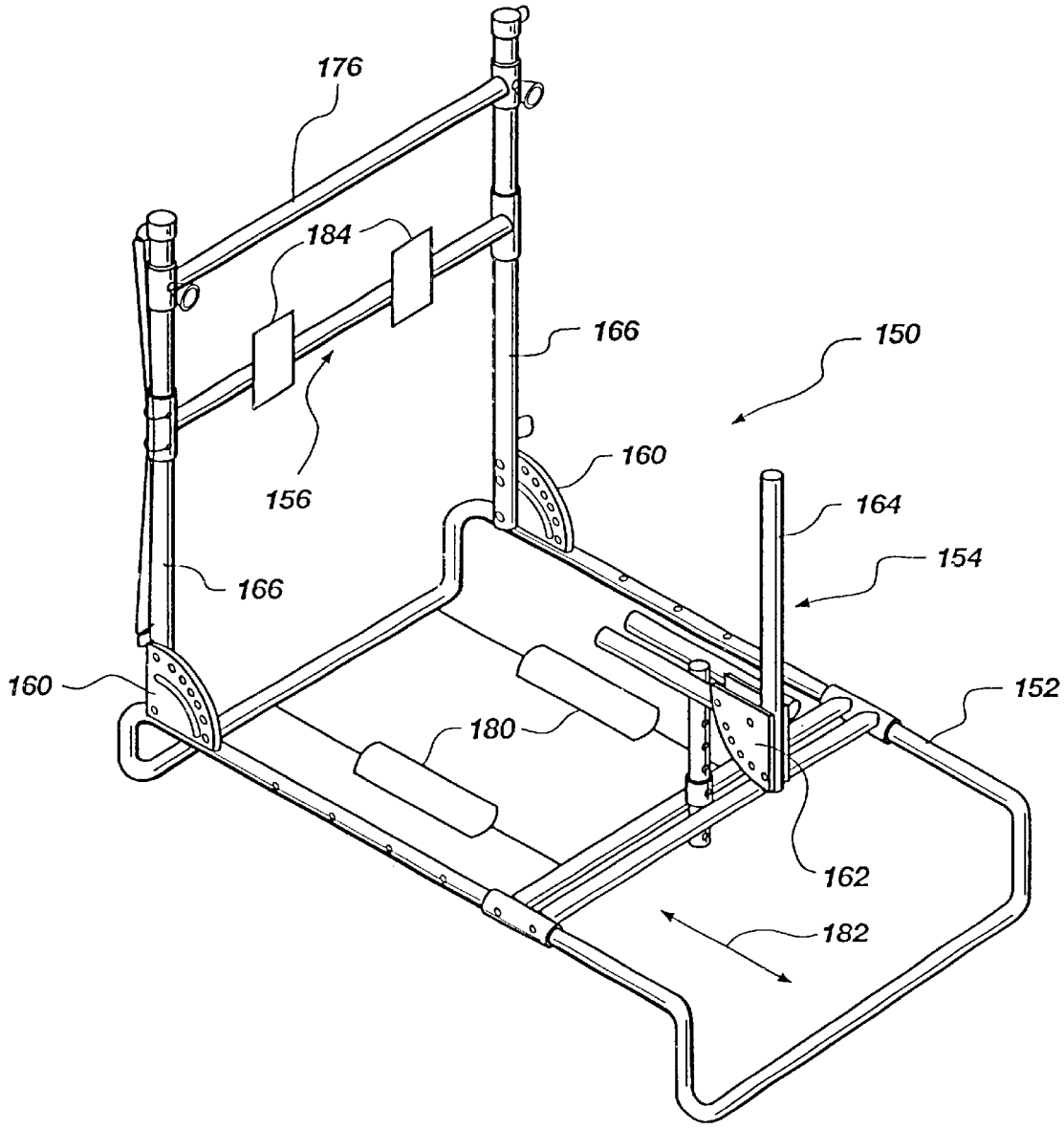
FIG. 14 is a perspective view of yet another embodiment of the present invention.

Reference will next be made to FIG. 14 which is a perspective view of another preferred embodiment of the present invention. The embodiment of the invention illustrated in FIG. 14 is similar to the embodiment represented in FIGS. 10–12 but with the inclusion of additional structures and desirable features.

As represented in FIG. 14, a pair of air cylinders 180 are connected between the seat assembly 154 and a member of the frame 152. Thus, as the user rests on the seat assembly 154, the user's legs or arms, which engage the horizontal bar assembly 156, can be exercised by sliding the seat assembly 154 along the frame 152 in the directions indicated by arrow 182 for an additional exercise accommodated by the present invention. It will be appreciated that the horizontal bar assembly 156 illustrated in FIG. 14 can be provided with extremity holding devices, represented by boxes 184 as can be devised by those skilled in the art, which can be used to hold the extremity of the user in place. The upper bar 212 and the lower bar 210, both represented in FIG. 13, can also function as the structure for receiving a body extremity in the embodiment illustrated in FIG. 14.

Figure 15:
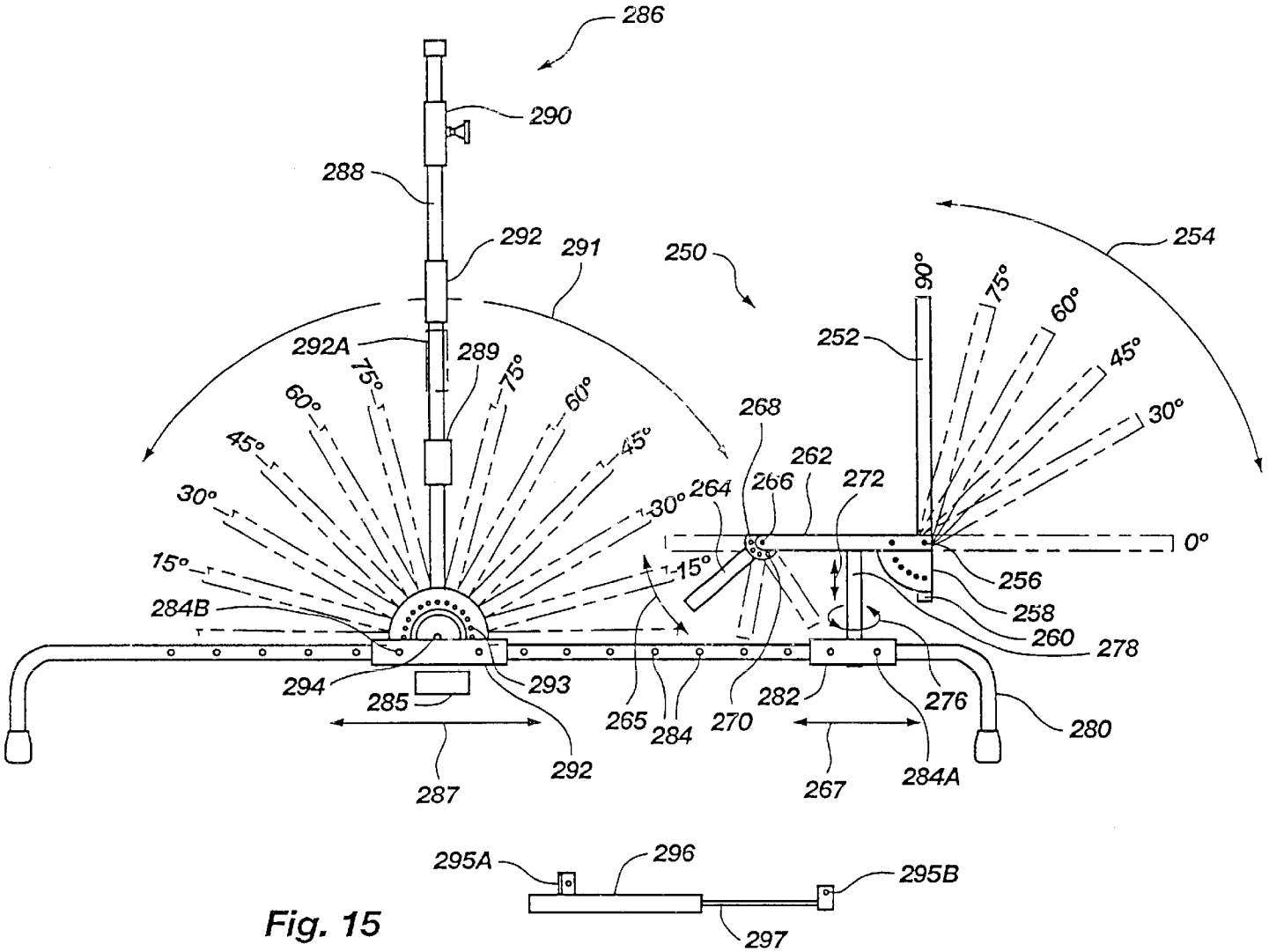
FIG. 15 is a side view of another embodiment of the present invention.

Reference will next be made to FIG. 15 which is a side view of another embodiment of the present invention. It will be appreciated that the embodiment represented in FIG. 15 shares many of the earlier described features with additional desirable features also being included. Represented in FIG. is an extremity range-of-motion resistance device generally indicated at 286 and an accompanying user support structure generally indicated at 250.

The user support structure 250 is represented as a frame-like device upon which cushions and other structures can be attached. For example, particularly when the apparatus described herein are used in a physical therapy application, the user support structure can include contoured surfaces to receive the user's body, straps and grips to allow the user to be held in place, and any other structures which can be devised by those knowledgeable in the industry which may be of assistance to the user. Moreover, devices for supporting the lumbar region of the user's back, such devices preferably being adjustable, are desirably included in some embodiments of the present invention.

The user support structure 250 includes a reclining back 252 which is attached to a horizontal member 262 (for supporting the user's buttocks) by way of a pivot 256. An angle plate 258 is provided with a plurality of bores (one of which is indicated at 260) which function to secure the reclining back 252 in one of a plurality of angular orientations. A pin or any :other suitable structure can be used with the bores 260 and the reclining back 252 to hold the reclining back in any one of the plurality of positions illustrated by the phantom images of the reclining back 252 and in the arc represented by arrow 254.

An adjustable leg rest 264 is attached to the horizontal member 262 by a pivot 266. Using an angle plate 268, the angular orientation of the adjustable leg rest 264 can be altered to any of the positions represented by the phantom images of the adjustable leg rest 264 and in the arc represented by arrow 265 in a manner similar to that just described in connection with the reclining back 252. The user support structure 250 can be adjusted vertically in the directions of arrow 272. The user support structure 250 is supported on a shaft 278 and preferably rotates in the directions of arrow 276.

The user support structure 250 is slidably attached to a frame 280 by way of a support sleeve 282. The support sleeve 282 can be fixed at any one of a plurality of positions along the frame using a pin or a bolt (not explicitly illustrated) inserted into one of a plurality of bores 284 and 284A. In contrast to fixing the position of the user support structure 250, the user support structure 250 can be allowed to slide along the frame 280 as the user engages in the exercise. A bidirectional resistance unit, preferably comprising a pneumatic resistance device 296 with a piston 297, can be attached to the frame 280 and the support sleeve 282 using hangers 295A and 295B, respectively, to add resistance to the sliding movement of the user support structure 250.

The extremity range-of-motion device 286 is mounted on the frame 280 and held in any desired position along the frame 280 in the directions of arrow 287 using bores 284 and 284B. Also represented in FIG. 15 is a post 288 attached to a sleeve 292 by way of a pivot 294. The post 288. holds a sleeve 290 connected to a brace member (not illustrated in FIG. 15) and a sleeve 292 (shown in phantom image 292A) connected to a bar which can receive a body extremity of a user and the directional force provided by the body extremity.

A resistance providing unit 289 is preferably included to impose resistance upon the movement of the bar. The post 288 can also pivot in the directions of arrow 291 and as represented by the phantom images of the post 288. A resistance providing unit 285 imposes resistance on the pivoting movement of the post 288 in the directions of the arrow 291. The post 288 can be locked into one of the positions shown by the phantom images of the post 288 using one of the bore 292. Alternatively, the post 288 can be allowed to pivot during exercise. Those skilled in the art will appreciate that the earlier described structures can also be included in the embodiment represented in FIG. 15. For example, any of the earlier described resistance providing structures can function as the resistance providing structures 285 and 289 in the embodiment represented in FIG. 15. It will be appreciated that the apparatus represented in FIG. 15 allows a user to engage in full range-of-motion exercises for a number of different portions of the human body, for example arms and legs.

Figure 16:
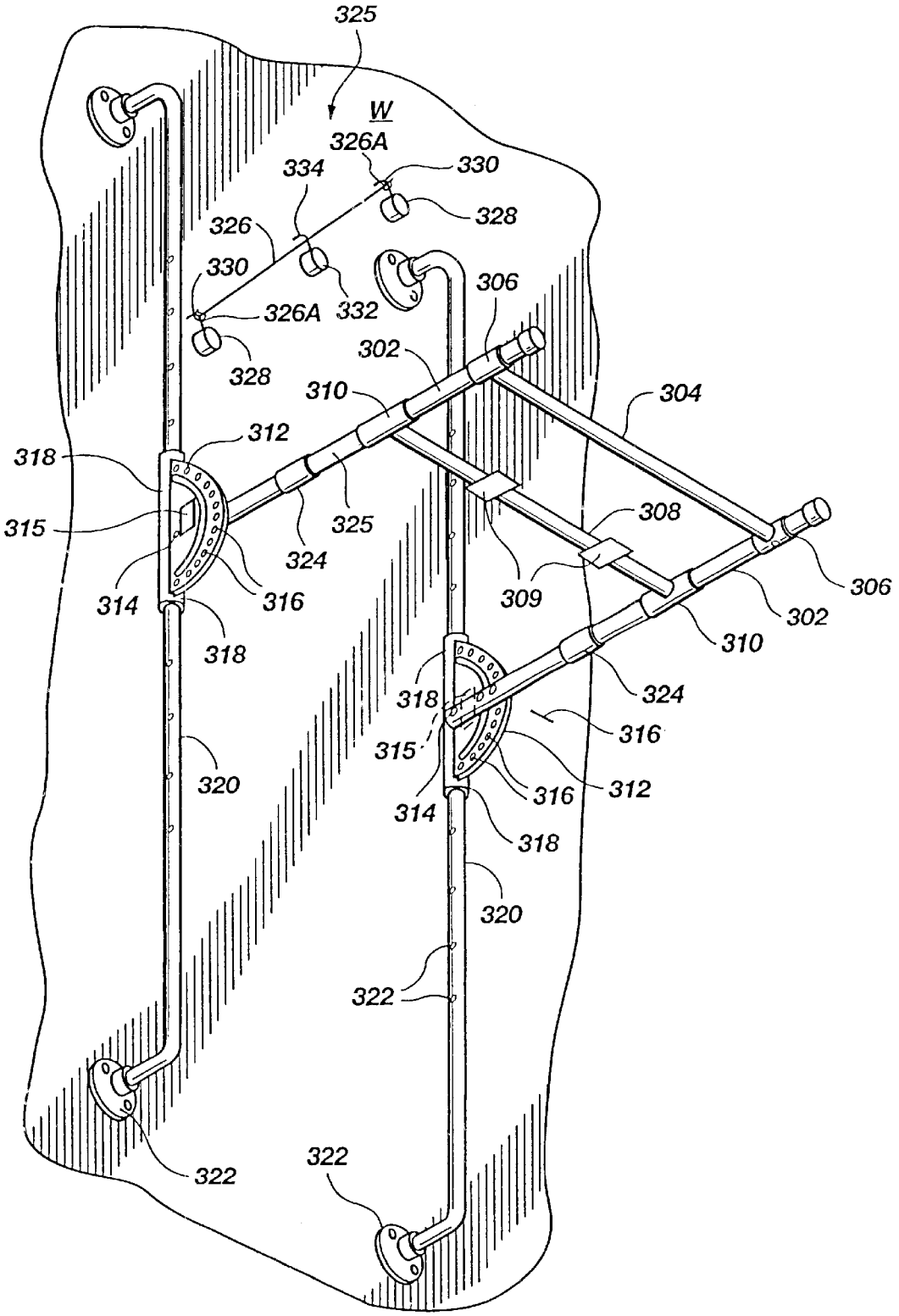
FIG. 16 is a perspective view of another embodiment of the present invention which is particularly adapted for mounting on a vertical surface.

Reference will next be made to FIG. 16 which is a perspective view of another range-of-motion exercise apparatus 300 which is particularly suited for mounting on a vertical surface, such as a wall W. When mounted on the wall W, the apparatus takes very little room to operate and can be folded against the wall W when not in use. Thus, even users with little spare room for exercise equipment can utilize the apparatus illustrated in FIG. 16. Moreover, the vertical mounting of the apparatus allows range-of-motion exercises to be efficiently carried out in a vertical direction.

As illustrated in FIG. 16, a frame 320 is preferably attached to the wall W using flanges 322. A pair of posts 302 are attached to respective sleeves 318 by way of pivots 314. The posts 302 can be locked in a desired angular orientation using the bores 316 on an angular positioning plate 312 or a resistance providing structure 315 can be provided to impose resistance on the pivoting movement of the posts 302 during exercise. A resistance providing device 313 is also provided to impose resistance on the movement of the sleeves 318 along the frame. A bar 308 is connected between sleeves 310 to allow movement of the bar 308 along the posts 302.

A resistance providing unit, preferably an air chamber 324 having a piston 325, is provided to impose resistance on the movement of the bar 308 along the posts 302. Also represented in FIG. 16 is an elastic resistance providing device generally indicated at 325 which can be attached to the range-of-motion exercise apparatus 300 and used in combination with a pneumatic resistance providing device such as that represented at 324. Alternatively, the resistance providing device 324 can be defeated or eliminated and the elastic resistance providing device 325 can be used alone. The elastic resistance providing device 325 includes an elastic cord 326, such as the elastic cords described earlier herein, which is stretched between hooks 330. The hooks 330 are removably secured to the posts 302 using releasable clamps 328 which can be any of a number of structures devised by those skilled in the art. A releasable clamp 332 is secured to the sleeve 310 and a releasable clip 334 holds the elastic cord 326 at the desired position. Depending upon the exercise being performed, only pneumatic resistance providing device or only an elastic resistance providing device can be used. Alternatively, in many instances both types of resistance providing devices can be advantageously used together.

Figure 16A:
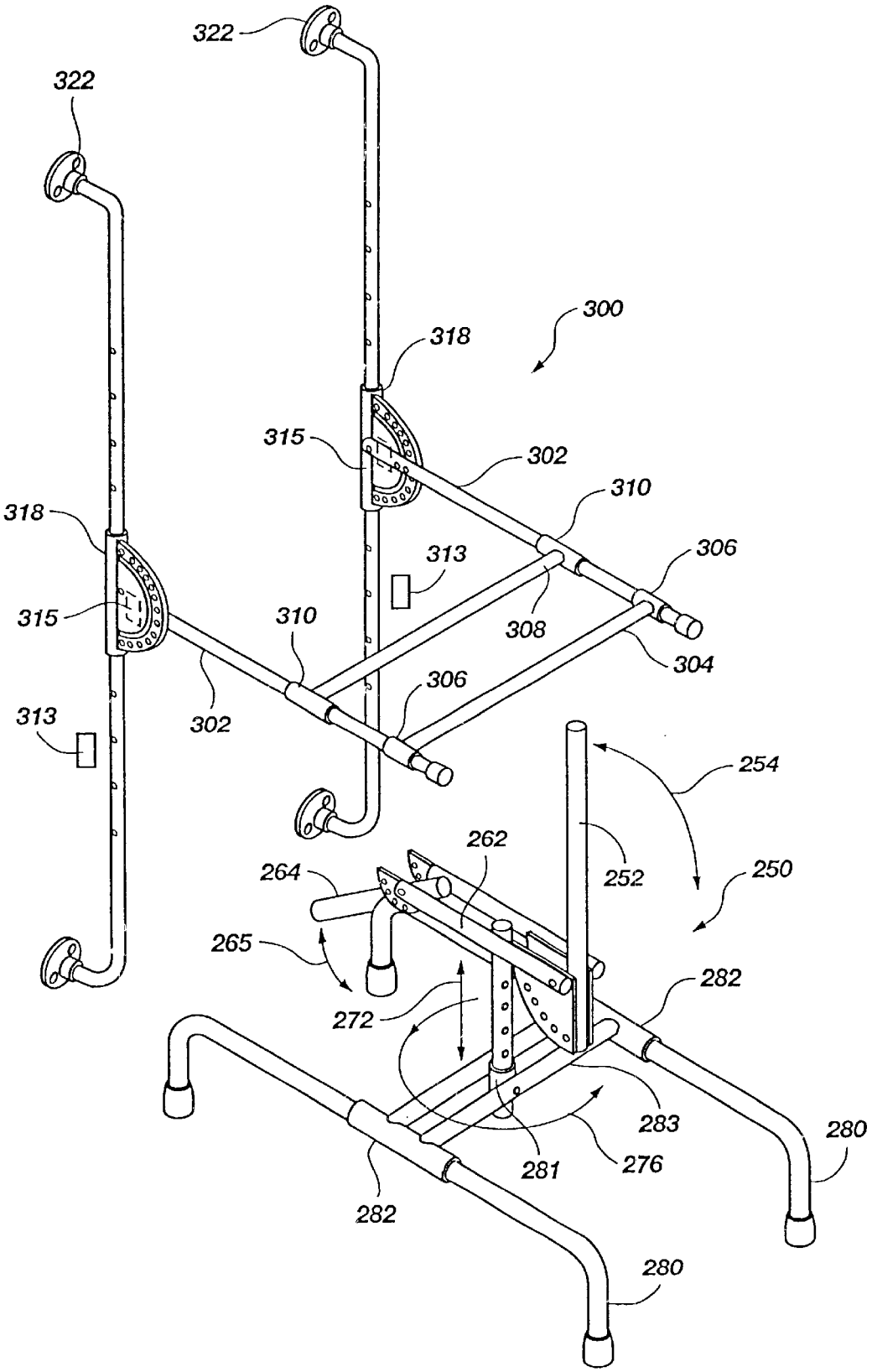
FIGS. 16A & 16B are perspective and side views, respectively, of a further embodiment of the present invention a portion of which is particularly suited for mounting on a vertical surface with user supporting structures resting on an adjacent horizontal surface.
Figure 16B:
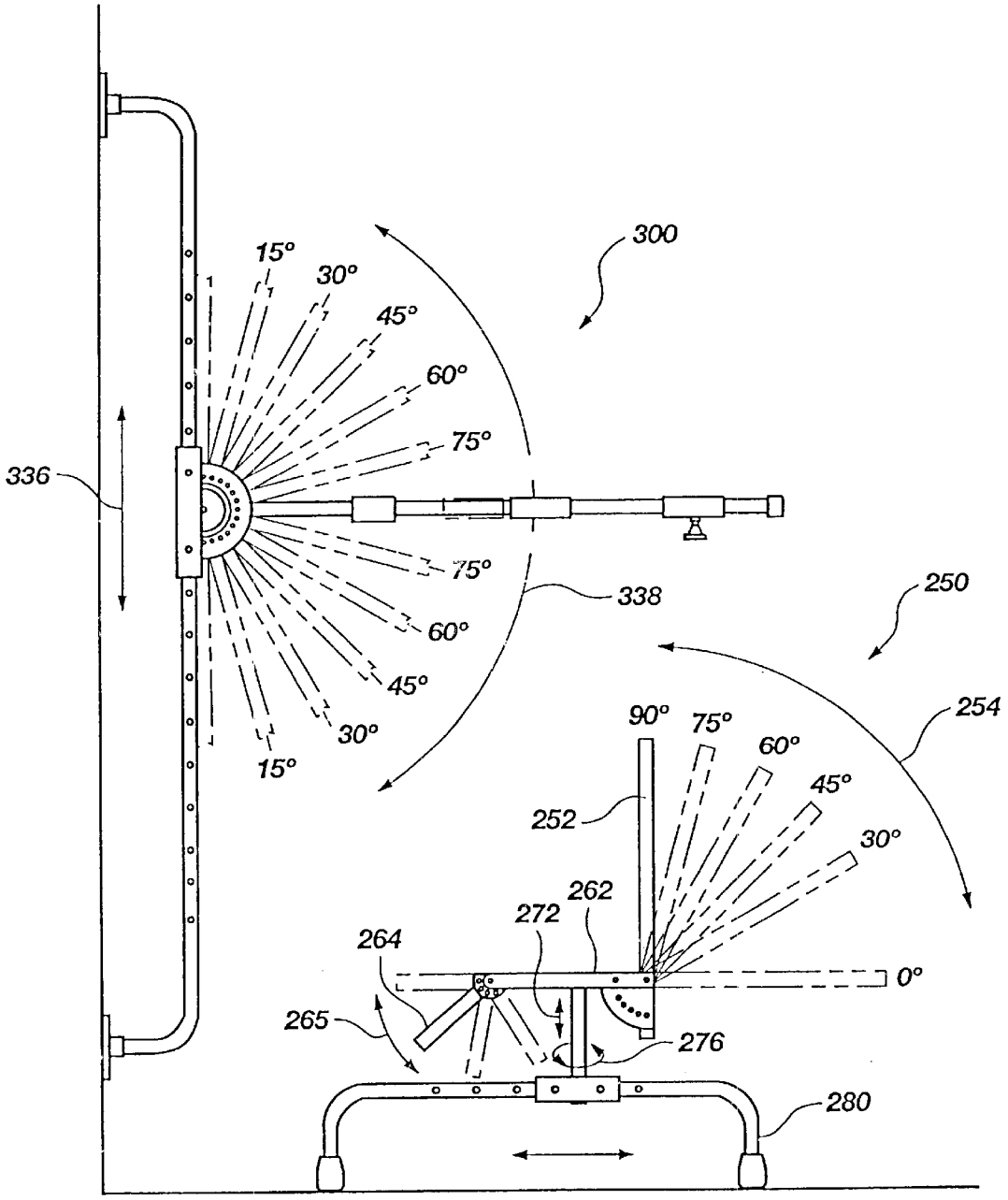
Figure 16C:
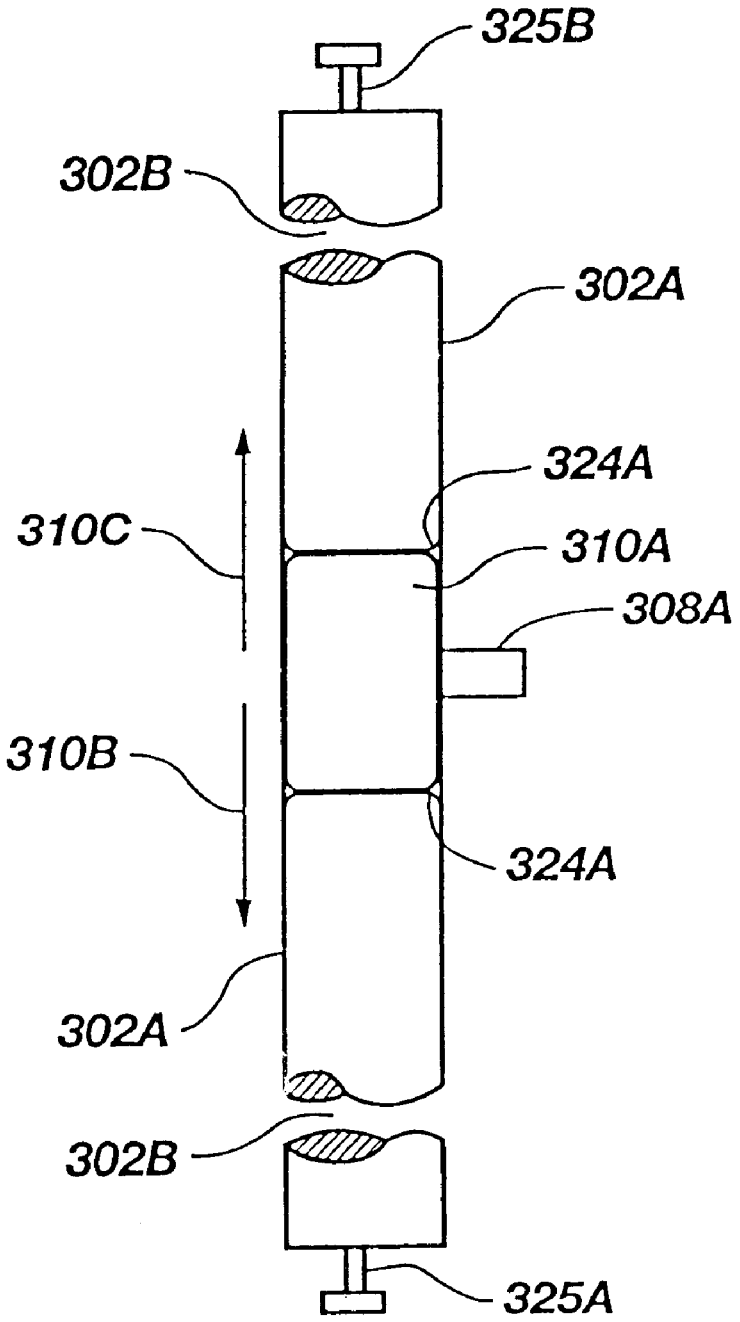
FIG. 16C is a representation of one preferred resistance imposing structure which can be used in accordance with the present invention.

FIG. 16C provides a cut away view of a post 302A which include a central hollow 302B and a short slot through which a bar 308A passes. The bar 308A is attached to a sliding member 310A to which a bar 308A is attached through the slot. The sliding member 310A fits closely within the central hollow 302B. At each end of the sliding member 310A are positioned sealing diaphragms 324A which form an air tight seal with the interior wall of the post 302A. The sealing diaphragms 324A can be fabricated by those skilled in the art or can be selected from those available in the industry. Each end of the posts 302A are provided with air release valves 325A–B as described earlier herein and as available in the art and most of the length of the post 302A is air tight.

Using the arrangement illustrated in FIG. 16C, as the sliding member 310A is moved in the direction of arrow 310B, air is forced out of air release valve 325A and into the interior of the post 302A through air release valve 325B. The resistance of the air passing through the air release valves 325A–B provides resistance to the movement of the sliding member 310A and the bar 308A. Advantageously, by adjusting the air release valves 325A–B, the resistance imposed in the direction of arrow 310B can be, if desired, different than the resistance imposed in the direction of arrow 310C.

The use of pneumatic resistance providing structures is preferred since the fluid medium is air and the resistance provided can be accurately and easily adjusted but other fluid motion dampening devices can also be used within the scope of the present invention. The arrangement represented in FIG. 16C makes the apparatus more compact and places structures out of harms way and away from potential interference. It will be appreciated that the other resistance providing devices, such as those described herein, can be positioned both on the interior and/or the exterior of the post 302 (FIG. 16) or any other tubular structure such as the frame 320 (FIG. 16).

Referring again to FIG. 16, a pair of extremity holding devices, represented at 309, are provided on the bar 308 and can be devised by those skilled in the art to hold the extremity of the user in place. Any of the extremity holding devices, such as slings, handles, pads, and other devices described earlier can be used. In particular, when slings are used as extremity holding devices a user can carry out range-of-motion exercises more naturally. Moreover, slings can allow impaired users to perform exercises which would not otherwise be possible. With the structure illustrated in FIG. 16, a user can effectively engage in many range-of-motion exercises, either for fitness or physical therapy purposes.

Reference will next be made to FIGS. 16A–B. FIG. 16A provides a perspective view of the range-of-motion exercise apparatus 300 mounted on a vertical surface with the user support structure 250 while FIG. 16B provides a side view of the same apparatus. The user support structure 250 is patterned after the corresponding structures described in connection with FIG. 15 with additional structures provided to allow positioning of the user supporting structure 250 on an underlying surface, such as a floor. Frame members 280 are shaped to rest upon a floor surface. Interconnecting members 283 are attached to sleeves 282. A tube 281 receives the cylinder 278 and means for allowing rotation of the user support structure 250 (in the directions of arrow 276) and means for adjusting the height of the user support structure 250 (in the directions of arrow 272) are preferably provided.

With the structures illustrated in FIGS. 16A&B, a user is allowed to carry out additional range-of-motion exercises. With the user support structure 250, the user can perform exercises involving the arms and legs from a sitting position. Without the user support structure 250, the user can perform appropriate exercises from while standing, kneeling, or laying on the floor. For example, a user can perform exercises with the apparatus moving through the arc represented at 338 in FIG. 16B and/or moving in the directions of arrow 336.

Figure 17:
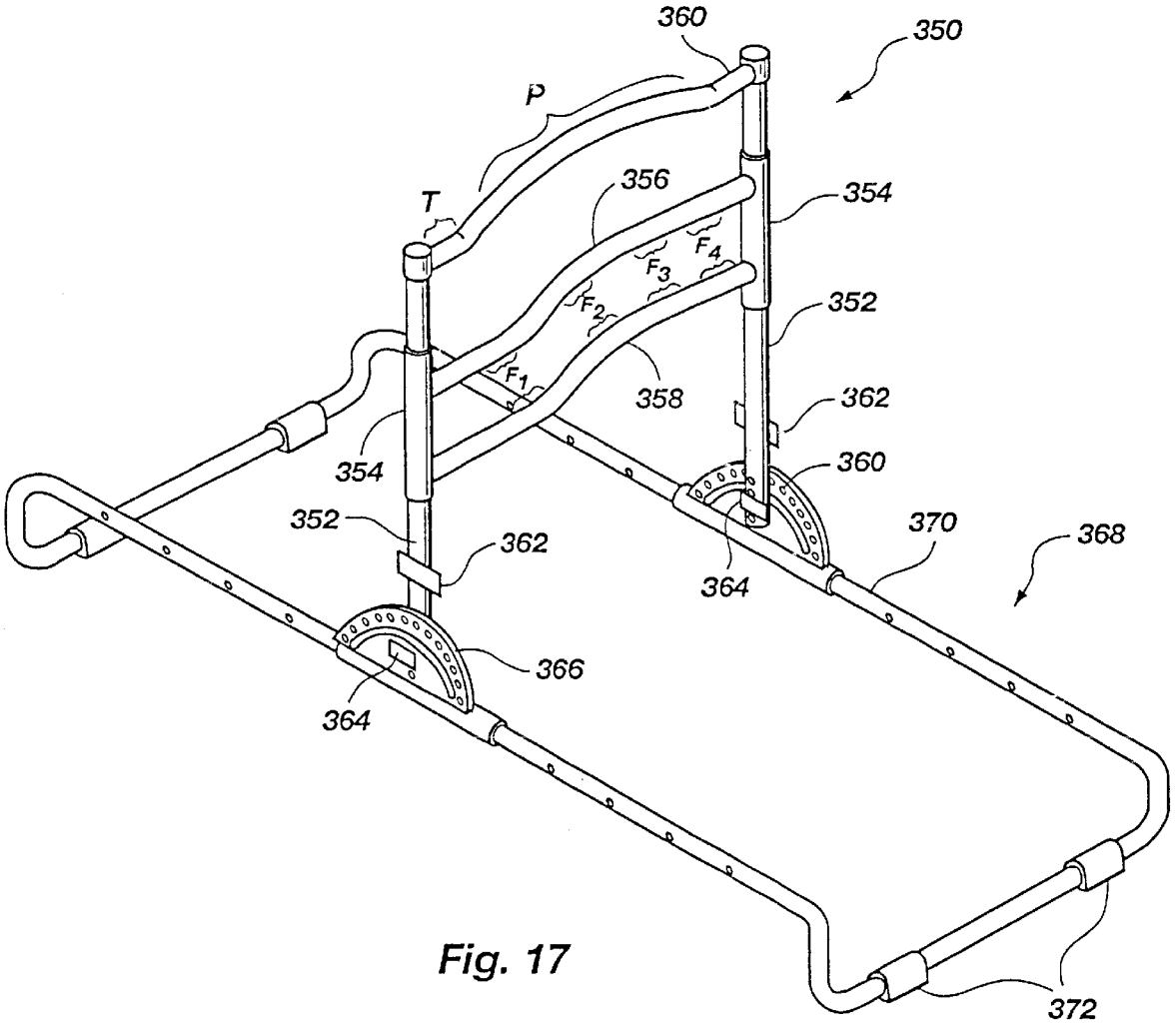
FIG. 17 is a perspective view of another embodiment of the present invention which is particularly suited for exercising a human hand and which conveniently rests upon a table top.

Reference will next be made to FIG. 17 which provides a perspective view of another embodiment of the present invention which is particularly suited for exercising a human hand and which conveniently rests upon a table top. The range-of-motion hand exerciser 350 represented in FIGS. 17, as well as the exercisers represented in FIGS. 18 and 19 to be described shortly, provide advantageous exercise for the hand, fingers, wrist and the associated regions of the human body. The apparatus is adaptable for performing exercises intended to strengthen a fully functional hand or performing exercises to rehabilitate an impaired hand. Providing an apparatus which performs the functions of the apparatus represented in FIGS. 17–19 satisfies a long-felt need in the industry. For example, occupational hand therapy is particularly beneficial to spinal, neck, and other back-related injuries since rehabilitation begins with the hands.

Represented in FIG. 17 is a frame, generally indicated at 368, which supports the range-of-motion exercise device which is particularly suited for exercising a human hand. The frame 370 includes a tubular member 370 provided with feet 372 to hold the frame 368 upon a surface, such as a table top.

Similarly to the previously described embodiments, a pair of posts 352 are pivotally attached to the frame 368 so that the plane defined thereby can be oriented at one of the desired angles provided by the bores on an angular positioning plate 366. A resistance providing device 364 can optionally be installed to impose resistance against the pivoting motion of the posts 352. A pair of ergonomically curved bars 356 and 358 are attached to sleeves 354 which slide along the posts 352. The advantage provided by the ergonomic curves will be explained shortly.

A palm support bar 360 is provided with an ergonomic curve the palm support bar attaches to the ends of the posts 352 to brace the same. A pair of resistance providing devices 362, which can preferably be pneumatic and/or elastic resistance providing devices as explained earlier, are provided to impose bidirectional resistance on the movement of the ergonomically curved bars 356 and 358.

The characteristic structure of the human hand is related to its function as a grasping tool. The human hand comprises three areas, a carpal area, a metacarpal area (palm), and phalanges (thumb and fingers). The human hand's grasping ability is made possible by the fact that the thumb is opposed to the fingers. Thus, the fingers and thumb of a hand act as versatile pair of pliers which can grasp objects of many different sizes and shapes. The palm of the hand is intended to provide a surface upon which grasped objects can rest.

The embodiment represented in FIG. 17 will be described when exercising a left human hand (not explicitly illustrated in the figures) with the understanding that the apparatus can be used for exercising either the left or the right hand. In use, the angle of the posts 354 is adjusted to suit the exercise being performed. The palm of the hand is placed upon the palm support bar 360 so that the thumb can curl around the palm support bar 360 in the area of the bar designated at T. The fingers of the hand are preferably placed between the ergonomically curved bar with the index finger being generally positioned in the areas designated at $F_1$, the middle finger being generally positioned in the areas designated at $F_2$, the ring finger being generally positioned in the areas designated at $F_3$, and the little finger being generally positioned in the areas designated at $F_4$. With the fingers of the hand positioned as just described, the hand assumes a natural position which is not possible. when previously available "straight" structures are used for grasping. With resistance being imposed against the movement of the ergonomically curved bars 356 and 358, the muscles of the fingers can be strengthened by the fingers pulling on the ergonomically curved bar 356 toward the palm support bar 360 and the fingers pushing on the ergonomically curved bar 358 away from the palm support bar 360.

It will be appreciated that the apparatus represented in FIG. 17 provides the advantages of working the hand in both extension and flexion motions and also through a wide range-of-motions. Moreover, a resistance providing device can be selected so that the resistance can preferably be adjusted for the needs of individual users. Thus, use of the described apparatus strengthens the hand, improves flexibility and dexterity, and carries out range-of-motion conditioning.

Figure 18:
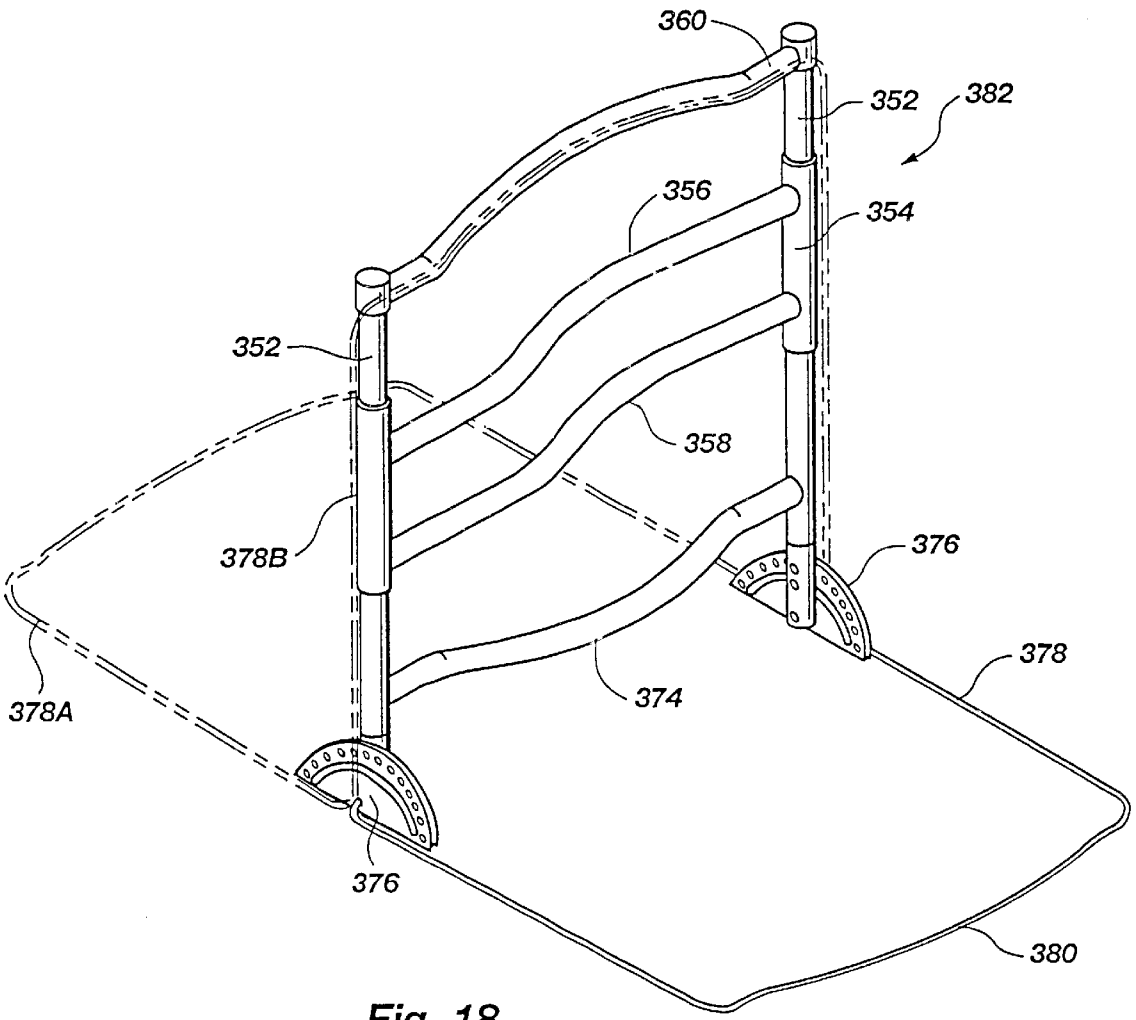
FIG. 18 is a perspective view of another embodiment of the present invention which is particularly suited for exercising a human hand and which can conveniently be used free standing and carried from location to location.

Reference will next be made to FIG. 18 which provides a perspective view of another embodiment of the present invention which is particularly suited for exercising a human hand and which can be conveniently carried in a portable fashion wherever a user desires to engage in exercise. It will be understood that some structures have not been represented in the view of FIG. 18 but that the explanation provided in connection with FIG. 17 also applies to the embodiment of the present invention represented in FIG. 18.

The embodiment represented in FIG. 18 is most preferably used while the user is holding it aloft away from any underlying surface. A frame 378 is provided which can be fixed in any of a number of angular positions (as indicated by the phantom images 378A and 378B) using the angular positioning plate 376 so that the range-of-motion hand exerciser 382 can be supported upon a table top if desired. If the range-of-motion hand exerciser is to be held aloft by a user, or if the frame 378 is not to be used, the frame 378 is folded into the position shown in phantom image 378B where it is kept until needed.

The range-of-motion hand exerciser 382 is provided with two palm support bars 360 and 374 so that a user may position a hand from either end of the exerciser. It will be appreciated that any of the resistance providing devices described herein can be incorporated into the range-of-motion hand exerciser 382.

Figure 19:
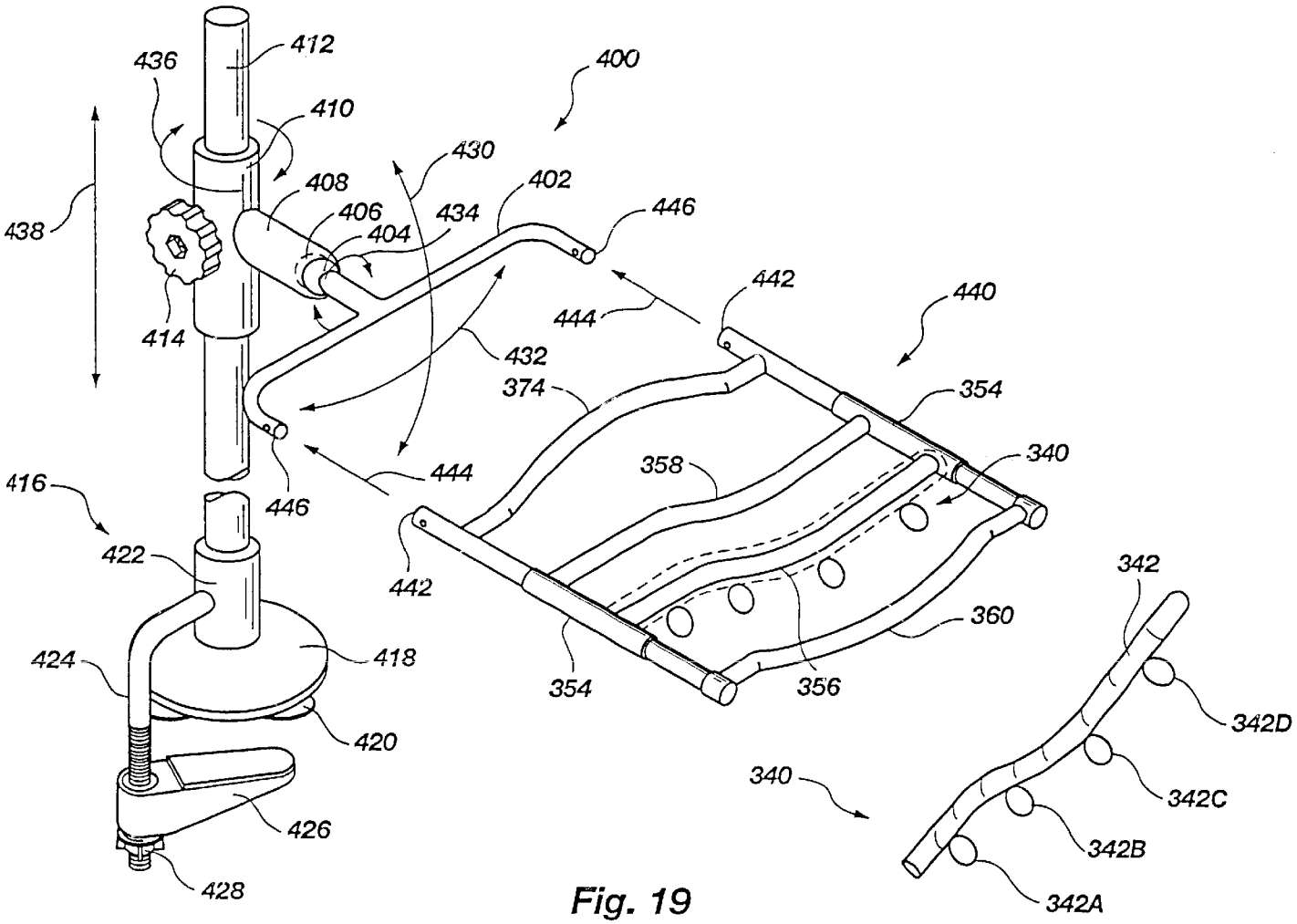
FIG. 19 is a perspective view of another embodiment of the present invention which can conveniently be mounted on a surface and which is particularly suited for exercising a human hand through any desired range-of-motion.

Reference will next be made to FIG. 19 which shows a range-of-motion hand exerciser generally indicated at 440 with a surface mounting mechanism generally indicated at 400. The surface mounting mechanism 400 allows the range-of-motion hand exerciser 440 to be oriented at any one of a plurality of angular orientations which is particularly desirable for a user.

The range-of-motion hand exerciser 440 includes palm support bars 360 and 374 with ergonomically curved bars 356 and 358 which are connected to sleeves 354. Resistance providing devices are to be included on the range-of-motion hand exerciser 440 as described earlier.

The surface mounting mechanism 400 includes a fork 402 with ends 446 which receive ends 442 of the range-of-motion hand exerciser 440 and are secured thereto. The fork 402 is attached to a single post 412 by way of a ball and socket joint which includes a ball 404 connected to the fork and a socket 406 formed in an arm 408. The arm 408 extends outward from a sleeve 410 which receives the post 412. A knob 414 engages and disengages a locking mechanism which, when the knob 414 is tightened; holds the sleeve 410 in place on the post 412 and holds the ball 404 in position in the socket 406.

The post 412 is secured to an underlying surface by an attachment mechanism generally indicated at 416. The attachment mechanism represented in FIG. 19 is particularly adapted to secure the post 412 onto a horizontally disposed table top (not represented) but the represented mechanism can be used for securement to other surfaces. The represented attachment mechanism 416 includes a base 418 with a lug 422 protruding therefrom and into which is received the post 412. A clamp finger 424 extends outward from the lug 422 and is provided with threads on its free end. A stop 426 is held in is place by a nut 428. When being used, a plurality of pads 420 provided on the bottom of the base 418 are positioned on a surface of a table or similar object. The stop 426 is also positioned and the nut 428 is tightened until the stop 426 is squeezed against the object's surface and the post 412 is securely secured thereto. Advantageously, the surface mounting mechanism 400 can be readily removed when desired. Importantly, any of a number of mechanisms for securing a post to an underlying surface can be devised by those skilled in the art and utilized with the embodiments of the present invention.

In accordance with another aspect of the present invention, a sling assembly, generally indicated at 340, can be removably attached to one or both of the ergonomically curved bars 356 and 358 as indicated by the phantom image of the sling assembly 340. The sling assembly 340 preferably includes a tube 342, whose shape matches or conforms to the shape of the ergonomically curved bars 356 and 358.

The tube 342 can preferably be fabricated from a tubular plastic material having slit formed therein through which the ergonomically curved bar 356 or 258 can slide. A plurality of finger slings 342A–D are preferably attached to the tube 342. While four finger slings are represented, it is within the scope of the present invention to only utilize one or more finger slings, to attach the finger slings in a different fashion, or to attach individual finger slings to the ergonomically curved bars 356 or 358. In many situations, it will be desirable to provide sling assemblies on both ergonomically curved bars 356 and 358. With a finger sling 324A–D, the user can readily; apply bidirectional force to the bar in either of the two directions which the bar can travel.

The use of slings, for example finger slings, enhances the use of the embodiments of the present with persons having impairments due to physical disabilities, injury, and even assist a user who is wearing a cast on an extremity. The slings are particularly useful when performing exercises which isolate a particular joint.

With the embodiment of the present invention represented in FIG. 19 being secured to a horizontal or vertical surface, the range-of-motion hand exerciser 440 can be moved in the directions of arrows 430, 432, 434, 438. The ability of the range-of-motion hand exerciser 440 to move within so many degrees of motion provides the benefit of precise positioning of the range-of-motion hand exerciser 440 for most efficiently exercising the muscles or muscle group which is desired.

Those skilled in the art will appreciate that the different features represented in the above described figures can be combined in many novel embodiments of the invention which have not been specifically described and which can be adapted to particular applications. It will be appreciated that the embodiments of the present invention provide advantages which are not available in any previously available devices. For example, the embodiments of the present invention can be adjusted such that maximal loading of the user's muscle occurs at any of the several points along its limited range-of-motion. Moreover, the embodiments of the present invention have great benefits when providing physical therapy for those who have suffered an injury or who have reduced capacity for exercise. Still further, the embodiments of the present invention provide bidirectional preconditioning for the prevention of injury and bidirectional rehabilitation and isolation of any repaired muscle group.

In contrast to the present invention are exercise devices in which the orientation of the device in relation to the user is fixed or in which the orientation can only be adjusted by moving the user's body. Even further, it will be appreciated that the present invention provides significant advantages over devices which utilize structures such as weights or mechanical springs for providing resistance to the movement of the user's extremity.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalence of the claims are to be embraced within their scope.

What is claimed and desired to be secured by United States Letters Patent is:

1. An exercise apparatus comprising:

frame means;

means for supporting the frame means on a non-horizontal surface;

means for receiving a body extremity of a user, said means for receiving a body extremity receiving a directional force provided by the body extremity, means for maintaining the means for receiving a body extremity in a predefined plane during movement in a first direction and in a second direction, the second direction opposing that of the first direction, both directions being contained within the predefined plane;

means for holding the means for maintaining at any one of a plurality of angular positions, and means for providing resistance to movement in both the first direction and in the second direction upon application of the force to the means for receiving a body extremity in either the first direction or the second direction, said force resulting in movement of the means for receiving a body extremity and such that the position of the means for receiving can be anthropometrically adjusted to suit different users and accommodate working different muscle groups.

2. An apparatus as in claim 1 further comprising means for supporting a user, the means for supporting a user comprising:

means for supporting a user's buttocks;

means for supporting a user's back connected to the means for supporting a user's buttocks;

means for adjusting the angular position of the means for supporting at user's back;

means for supporting the lumbar region of the user's back connected to the means for supporting a user's buttocks;

means for supporting a user's leg connected to the means for supporting for supporting a user's buttocks; and means for adjusting the angular position of the means for supporting a user's leg.

3. An apparatus as in claim 1 wherein the means for maintaining the means for receiving a body extremity in a predefined plane during movement is further for limiting movement of the means for receiving a body extremity to movement in one dimension and wherein the means for maintaining the means for receiving a body extremity in a predefined plane during movement comprises at least one sleeve attached to the means for receiving a body extremity and a post upon which the sleeve is slidably mounted.

4. An apparatus as in claim 3 wherein the sleeve is cylindrical in shape and includes a hollow central portion, the post upon which the sleeve is slidably mounted passing through the central portion of the sleeve and wherein the post is disposed vertically to provide a vertical range-of-motion.

5. An apparatus as in claim 1 further comprising means for pivoting the means for maintaining through an angular range-of-motion of at least forty-five degrees.

6. An apparatus as in claim 1 further comprising means for providing resistance to movement of the means for maintaining as it is moved from one angular position to another angular position.

7. An apparatus as in claim 1 wherein the means for receiving a body extremity comprises at least one sling into which a body extremity may be inserted.

8. An apparatus as in claim 1 wherein the means for providing resistance to movement comprises a length of elastic material.

9. An apparatus as in claim 1 wherein the means for providing resistance to movement comprises a pneumatic resistance providing device.

10. An apparatus as in claim 1 wherein the means for providing resistance to movement comprises a length of elastic material and a pneumatic resistance providing device.

11. An apparatus as in claim 1 wherein the position of the means for receiving can be adjusted such that maximal loading of at least one of said muscle groups can occur at any one of several points along the range-of-motion of said muscle group.

12. An apparatus as in claim 1 further comprising means for adjusting the resting position of the means for receiving a body extremity.

13. An ergonomic grasping apparatus for exercising a human hand including a palm, a thumb, and four fingers, the apparatus comprising:

means for receiving the palm of the user's hand;

first means for receiving a first finger and a second finger of the four fingers and maintaining the first and the second fingers at a first distance from the means for receiving the palm;

second means for receiving a third finger and a fourth finger of the four fingers and maintaining the third and the fourth fingers at a second distance from the means for receiving the palm, the second distance being different than the first distance;

means for maintaining the first and the second means for receiving in a predefined plane during movement in a first direction;

means for providing resistance to movement in the first direction upon application of force to the first and the second means for receiving such that the fingers and the hand are exercised by the movement of the first, second, third, and fourth fingers.

14. An apparatus as defined in claim 13 wherein the means for receiving the palm of the user's hand comprises a curved palm rest.

15. An apparatus as defined in claim 13 wherein the first means for receiving a first finger and a second finger of the four fingers comprises a finger sling.

16. An apparatus as defined in claim 13 wherein the first means for receiving a first finger and a second finger comprises a first portion of a curved member and wherein the second means for receiving a third finger and a fourth finger comprises a second portion of the curved member, the first portion of the curved member positioned closer to the means for receiving the user's palm than the second portion of the curved member.

17. An apparatus as defined in claim 13 wherein the means for maintaining the first and the second means for receiving in a predefined plane during movement in a first direction comprises a post and a sleeve slidably positioned on the post, the first and the second means for receiving being connected to the sleeve.

18. An apparatus as defined in claim 13 wherein the means for providing resistance to movement in the first direction comprises means for pneumatically providing resistance to movement of the means for receiving.

19. An apparatus as defined in claim 13 wherein the means for providing resistance to movement in the first direction comprises means for elastically providing resistance to movement of the means for receiving.

20. An apparatus as defined in claim 13 wherein the means for maintaining the first and the second means for receiving in a predefined plane during movement in a first direction comprises means for maintaining the first and the second means for receiving in a predefined plane during movement in both a first direction and a second direction and wherein the means for providing resistance to movement in the first direction comprises means for providing resistance to the first and the second means for receiving in both the first direction and the second direction.

* * * * *

UNITED STATES PATENT AND TRADEMARK OFFICE

CERTIFICATE OF CORRECTION

PATENT NO. : 6,416,447 B1
DATED : July 9, 2002
INVENTOR(S) : Harmon

It is certified that error appears in the above-identified patent and that said Letters Patent is hereby corrected as shown below:

Title page,
Item [60], Related U.S. Application Data, add the following:
-- Continuation of application No. 08/481,807, Jun. 7, 1995, Pat. No. 5,913,749, which is a continuation-in-part of application No. 08/259,037, Jun. 13, 1994, Pat. No. 5,478,299, which is a continuation-in-part of application No. 08/041,833, Apr. 1, 1993, Pat. No. 5,320,591, which is a continuation-in-part of application No. 07/698, 399, May 10, 1991, abandoned. --
Item [57], ABSTRACT,
Line 8, "...may positioned..." is corrected to -- ...may be positioned… --

Column 1,
Line 43, "...a educated trainer." is corrected to -- ...an educated trainer... --
Line 51, "...exercise or therapy, field which combines..." is corrected to -- ...exercise or therapy field which combines… --

Column 2,
Line 21, "...invention. is to provide..." is corrected to -- ...invention is to provide... --

Column 3,
Line 16, "...movement of body extremity." is corrected to -- ...movement of a body extremity. --
Line 25, "...wheelchair so that person confined..." is corrected to -- ...wheelchair so that a person confined... --
Line 34, "...angle or leg support," is corrected to -- ...angle of leg support, --
Line 38, "...sized for exercising user's hand and fingers..." is corrected to -- ...sized for exercising the user's hand and fingers... --
Line 51, "The bar is be pushed or pulled..." is corrected to -- The bar is to be pushed or pulled... --

Column 4,
Line 27, "...front elevational view another embodiment..." is corrected to
-- ...front elevational view of another embodiment... --

Column 6,
Line 9, "...receiving a body extremity. of a user..." is corrected to
-- ...receiving a body extremity of a user... --

UNITED STATES PATENT AND TRADEMARK OFFICE

CERTIFICATE OF CORRECTION

PATENT NO. : 6,416,447 B1
DATED : July 9, 2002
INVENTOR(S) : Harmon

It is certified that error appears in the above-identified patent and that said Letters Patent is hereby corrected as shown below:

Column 7,
Line 4, "...can also preferably used therewith..." is corrected to -- ...can also be preferably used therewith... --
Line 8, "surgical tubing' Moreover," is corrected to -- "surgical tubing." Moreover, --

Column 8,
Line 8, "...may include an aperture.66 which at..." is corrected to -- ...may include an aperture 66 which at... --
Line 9, "positions corresponds, to one..." is corrected to -- positions corresponds to one... --

Column 10,
Line 11, "...characteristics of resistance providing device..." is corrected to -- ...characteristics of the resistance providing device... --

Column 11,
Line 38, "ninety about degrees" is corrected to -- about ninety degrees... --

Column 12,
Line 17, "...movement of the hand in when engaging" is corrected to -- ...movement of the hand when engaging... --

Column 13,
Lines 40-41, "Represented in FIG. is an extremity range-of-motion..." is corrected to -- Represented in FIG. 15 is an extremity range-of-motion... --
Line 63, "A pin or any :other suitable structure..." is corrected to -- A pin or any other suitable structure... --

Column 14,
Line 31, "The post 288. holds a..." is corrected to -- The post 288 holds a... --

Column 15,
Line 62, "...out of harms way..." is corrected to -- ...out of harm's way... --

Column 16,
Line 35, "...exercises from while standing, kneeling..." is corrected to -- ...exercises while standing, kneeling... --
Lines 45-46, "FIGS. 17,..." is corrected to -- FIG. 17,... --

UNITED STATES PATENT AND TRADEMARK OFFICE

CERTIFICATE OF CORRECTION

PATENT NO. : 6,416,447 B1
DATED : July 9, 2002
INVENTOR(S) : Harmon

It is certified that error appears in the above-identified patent and that said Letters Patent is hereby corrected as shown below:

Column 17,
Lines 7-8, "...with an ergonomic curve the palm support bar attaches..." is corrected to -- ...with an ergonomic curve. The palm support bar attaches... --
Lines 15-16, "The human hand comprises three areas, a carpal area, a metacarpal..." is corrected to -- The human hand comprises three areas: a carpal area, a metacarpal... --
Line 20, "versatile pair of pliers..." is corrected to -- a versatile pair of pliers... --

Column 18,
Line 37, "...knob 414 is tightened; holds the sleeve..." is corrected to -- ...knob 414 is tightened holds the sleeve… --
Line 50 "...is held in is place by a nut..." is corrected to -- ...is held in place by a nut... --

Column 19,
Line 3, "...curved bar 356 or 258 can slide." is corrected to -- curved bar 356 or 358 can slide. --
Line 11, "user can readily; apply bidirectional..." is corrected to -- user can readily apply bidirectional... --
Line 15, "...embodiments of the present with persons having..." is corrected to -- ...embodiments of the present invention with persons having... --

Column 20,
Line 26, "supporting at user's back;" is corrected to -- supporting a user's back --
Line 31, "for supporting for supporting a user's buttocks; and" is corrected to -- for supporting a user's buttocks; and --

Signed and Sealed this

Fourth Day of November, 2003

JAMES E. ROGAN
*Director of the United States Patent and Trademark Office*